US009259941B2

(12) United States Patent
Watanabe et al.

(10) Patent No.: US 9,259,941 B2
(45) Date of Patent: Feb. 16, 2016

(54) IMAGE FORMING APPARATUS, IMAGE FORMING SYSTEM, AND METHOD OF PRODUCING PRINTED PRODUCT

(71) Applicants: Tatsuro Watanabe, Kanagawa (JP); Koji Nagai, Kanagawa (JP); Hiroyuki Hiratsuka, Kanagawa (JP)

(72) Inventors: Tatsuro Watanabe, Kanagawa (JP); Koji Nagai, Kanagawa (JP); Hiroyuki Hiratsuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/553,965

(22) Filed: Nov. 25, 2014

(65) Prior Publication Data

US 2015/0165789 A1 Jun. 18, 2015

(30) Foreign Application Priority Data

Nov. 29, 2013 (JP) ..... 2013247546
Oct. 24, 2014 (JP) ..... 2014217808

(51) Int. Cl.

| | |
|---|---|
| ***B41J 2/01*** | (2006.01) |
| ***B41J 11/00*** | (2006.01) |
| ***B41J 11/36*** | (2006.01) |
| ***B41J 15/00*** | (2006.01) |

(52) U.S. Cl.

CPC ..... *B41J 11/0015* (2013.01); *B41J 11/36* (2013.01); *B41J 15/005* (2013.01)

(58) Field of Classification Search

CPC .. B41J 11/0015; B41J 11/002; B41J 13/0009; B41J 15/00

See application file for complete search history.

(56) References Cited

U.S. PATENT DOCUMENTS

| | | | | |
|---|---|---|---|---|
| 6,104,496 | A * | 8/2000 | Minowa et al. | 358/1.12 |
| 6,939,429 | B2 * | 9/2005 | Takemura | 156/302 |
| 2007/0058019 | A1 | 3/2007 | Saitoh et al. | |
| 2009/0290007 | A1 | 11/2009 | Saitoh et al. | |
| 2011/0064489 | A1 | 3/2011 | Bisaiji et al. | |
| 2013/0249992 | A1 * | 9/2013 | Katagami et al. | 347/16 |
| 2014/0078212 | A1 | 3/2014 | Nakai et al. | |
| 2014/0160197 | A1 | 6/2014 | Hirose et al. | |
| 2014/0265911 | A1 | 9/2014 | Kamata et al. | |
| 2014/0268966 | A1 | 9/2014 | Kamata | |

FOREIGN PATENT DOCUMENTS

| | | | |
|---|---|---|---|
| JP | 10-226058 | | 8/1998 |
| JP | 2002-307807 | | 10/2002 |
| JP | 2010-201690 | | 9/2010 |
| JP | 2012081608 | A * | 4/2012 |
| JP | 5082696 | | 9/2012 |
| JP | 2012-081608 | | 4/2014 |

* cited by examiner

*Primary Examiner* — Shelby Fidler
*Assistant Examiner* — Tracey McMillion
(74) *Attorney, Agent, or Firm* — Duft Bornsen & Fettig LLP

(57) ABSTRACT

An image forming apparatus includes: a driving unit that feeds a treatment object; a pretreatment unit that performs pretreatment on a surface of the treatment object fed by the driving unit; a retaining unit that retains the treatment object on which the pretreatment has been performed in the pretreatment unit; an image forming unit that performs image formation on the treatment object after being retained in the retaining unit; and a drive control unit that controls the driving unit so as to return the treatment object from the retaining unit at least to the pretreatment unit if the treatment object has been retained in the retaining unit for a time longer than a predetermined time after being subjected to the pretreatment in the pretreatment unit, and to feed the treatment object on which the pretreatment has been performed again in the pretreatment unit to the retaining unit.

6 Claims, 10 Drawing Sheets

IMAGE FORMING APPARATUS, IMAGE FORMING SYSTEM, AND METHOD OF PRODUCING PRINTED PRODUCT

CROSS-REFERENCE TO RELATED APPLICATIONS

The present application claims priority to and incorporates by reference the entire contents of Japanese Patent Application No. 2013-247546 filed in Japan on Nov. 29, 2013 and Japanese Patent Application No. 2014-217808 filed in Japan on Oct. 24, 2014.

BACKGROUND OF THE INVENTION

1. Field of the Invention

The present invention relates to an image forming apparatus, an image forming system, and a method of producing a printed product.

2. Description of the Related Art

Technologies have so far been known that allow higher quality printing results to be obtained by performing pretreatment on a sheet to be printed immediately before printing in an image forming apparatus. For example, plasma treatment can be performed as the pretreatment on a surface of the sheet. An image forming system that performs the pretreatment includes, for example, a pretreatment apparatus and an image forming apparatus; a sheet fed from a sheet feeding unit is fed to the pretreatment apparatus and is pretreated, and the sheet output from the pretreatment apparatus after the pretreatment is completed is fed to the image forming apparatus.

The sheet to be printed is often provided as a cut sheet that is cut in advance in a predetermined size, such as A4 size or B5 size, or as continuous sheet. One of type of a continuous sheet that has a roll form among types of the continuous sheet is specially called a rolled sheet.

The pretreatment apparatus and the image forming apparatus often differ from each other in conveying speed and conveying timing of the sheet. Hence, technologies have already been known that allow the difference in conveying speed and conveying timing of the sheet to be absorbed by providing a sheet buffer area that temporarily stores the sheet between the pretreatment apparatus and the image forming apparatus. When the rolled sheet is used as the sheet to be printed, the sheet buffer area temporarily stores the sheet, for example, by bending the sheet so as to absorb the difference between the conveying speeds in the pretreatment apparatus and the image forming apparatus.

Japanese Patent Application Laid-open No. 2012-081608 discloses a printer that includes a corona treatment apparatus that performs surface treatment on a printing medium, an inkjet printer that performs printing on the printing medium with the surface treated by the corona treatment apparatus, and a buffer unit that is provided between the corona treatment apparatus and the inkjet printer and temporarily stores the printing medium by bending it.

In the configuration in which the sheet after being pretreated is bent in the sheet buffer area and conveyed to the image forming apparatus, the pretreated sheet can be stopped being conveyed while being stored in the sheet buffer area due to, for example, turning off of the power supply of the apparatus. In this case, the sheet pretreated and stored in the sheet buffer area is left in the sheet buffer area without being fed to the image forming apparatus until the next printing operation is started.

The effect of the surface treatment by the pretreatment onto the sheet decreases with time. The decrease of the surface treatment effect causes a problem that, when the sheet left in the sheet buffer area is fed to the image forming apparatus and an image is formed on the sheet, the quality of the printed image is degraded.

In view of the above, there is a need to obtain an appropriate effect of the surface treatment in the configuration including the sheet buffer after the surface treatment and before the image formation onto the sheet.

SUMMARY OF THE INVENTION

It is an object of the present invention to at least partially solve the problems in the conventional technology.

An image forming apparatus includes: a driving unit that feeds a treatment object; a pretreatment unit that performs pretreatment on a surface of the treatment object fed by the driving unit; a retaining unit that retains the treatment object on which the pretreatment has been performed in the pretreatment unit; an image forming unit that performs image formation on the treatment object after being retained in the retaining unit; and a drive control unit that controls the driving unit so as to return the treatment object from the retaining unit at least to the pretreatment unit if the treatment object has been retained in the retaining unit for a time longer than a predetermined time after being subjected to the pretreatment in the pretreatment unit, and to feed the treatment object on which the pretreatment has been performed again in the pretreatment unit to the retaining unit.

An image forming system includes: a sheet feeding apparatus that feeds a treatment object; a pretreatment apparatus that performs pretreatment on a surface of the treatment object fed by the sheet feeding apparatus; a buffer apparatus that retains the treatment object on which the pretreatment has been performed in the pretreatment apparatus; an image forming apparatus that performs image formation on the treatment object after being retained in the buffer apparatus; and a drive control unit that controls the sheet feeding apparatus so as to return the treatment object from the buffer apparatus at least to the pretreatment apparatus if the treatment object has been retained in the buffer apparatus for a time longer than a predetermined time after being subjected to the pretreatment in the pretreatment apparatus, and to feed the treatment object on which the pretreatment has been performed again in the pretreatment apparatus to the buffer apparatus.

A method of producing a printed product includes: driving to feed a treatment object; performing pretreatment on a surface of the treatment object fed at the driving in a pretreatment unit; retaining the treatment object on which the pretreatment has been performed at the performing pretreatment in a retaining unit; performing image formation on the treatment object after being retained at the retaining; and controlling the driving so as to return the treatment object from the retaining unit at least to the pretreatment unit if the treatment object has been retained at the retaining for a time longer than a predetermined time after being subjected to the pretreatment at the performing pretreatment, and to feed the treatment object on which the pretreatment has been performed again at the performing pretreatment to the retaining unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of an image forming apparatus, an image forming system, and a method of producing a printed product will be described below in detail with reference to the accompanying drawings.

First Embodiment

Figure 1:
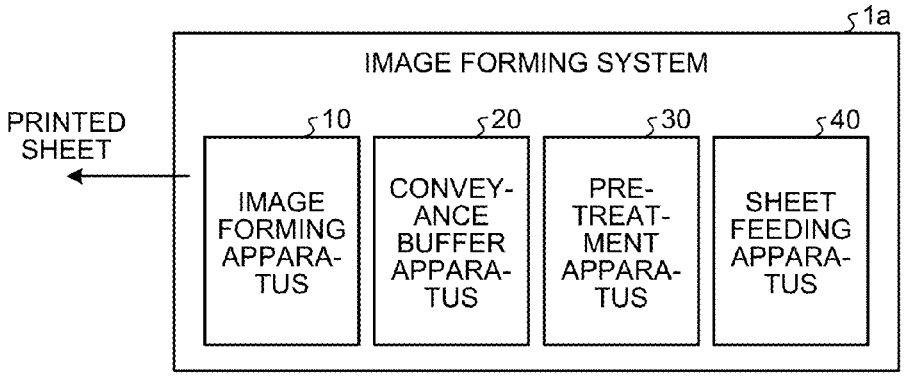
FIG. 1 is a block diagram illustrating an example of the configuration of an image forming system according to a first embodiment of the present invention.

FIG. 1 illustrates the configuration of an example of an image forming system 1*a* according to a first embodiment of the present invention. As illustrated in FIG. 1, the image forming system 1*a* includes an image forming apparatus 10, a conveyance buffer apparatus 20, a pretreatment apparatus 30, and a sheet feeding apparatus 40.

The sheet feeding apparatus 40 stores a sheet to be printed that serves as a treatment object, and conveys the sheet toward the image forming apparatus 10. The sheet fed from the sheet feeding apparatus 40 is conveyed via the pretreatment apparatus 30 and the conveyance buffer apparatus 20, and fed to the image forming apparatus 10, where an image is formed and printed on the sheet.

While FIG. 1 illustrates the configuration in which the image forming apparatus 10, the conveyance buffer apparatus 20, the pretreatment apparatus 30, and the sheet feeding apparatus 40 are provided in separate housings, the configuration is not limited to this example. For example, the image forming system 1*a* including the image forming apparatus 10, the conveyance buffer apparatus 20, the pretreatment apparatus 30, and the sheet feeding apparatus 40 may be configured as one apparatus, or apparatuses adjacent to each other may be configured as one apparatus.

Figure 2:
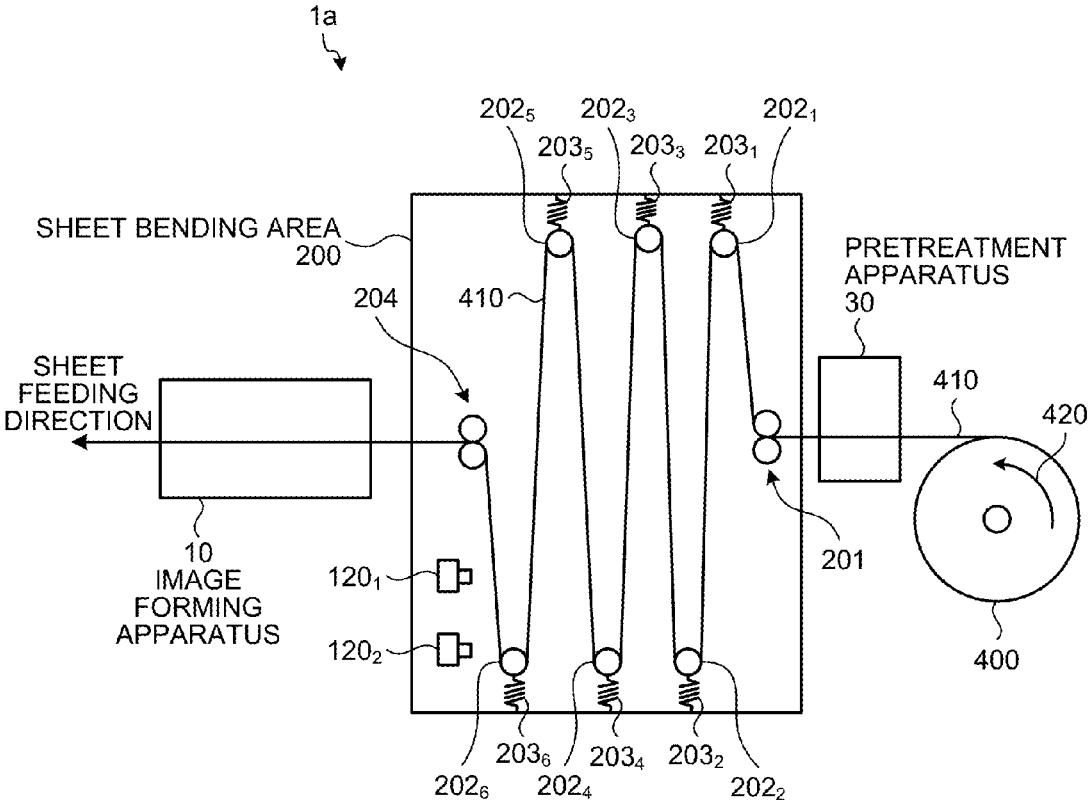
FIG. 2 is a diagram illustrating more in detail the example of the configuration of the image forming system according to the first embodiment, with a focus on a conveyance buffer apparatus.

FIG. 2 illustrates more in detail the example of the configuration of the image forming system according to the first embodiment, with a focus on the conveyance buffer apparatus 20. In the sheet feeding apparatus 40, a roll 400 formed by winding a sheet 410 is rotationally driven by a motor (not illustrated) in the direction indicated by the arrow 420, and the sheet 410 is fed in the sheet feeding direction. At this time, the sheet 410 is fed at a speed corresponding to the treatment speed of the pretreatment apparatus 30. The sheet 410 fed from the sheet feeding apparatus 40 is fed to the pretreatment apparatus 30.

The pretreatment apparatus 30 performs predetermined surface treatment on a printing surface of the fed sheet 410 to be printed so as to increase compatibility of the sheet 410 with printing. The pretreatment apparatus 30 performs, for example, plasma treatment, as the surface treatment, on the sheet 410. The surface treatment is not limited to such an example, but the pretreatment apparatus 30 may perform, for example, corona treatment, heat treatment, or pressure treatment, as the surface treatment, on the sheet 410. The pretreatment apparatus 30 may also perform the surface treatment on the back surface, in addition to the printing surface, of the sheet 410. The sheet 410 with the surface treatment performed by the pretreatment apparatus 30 is fed to the conveyance buffer apparatus 20.

The conveyance buffer apparatus 20 bends and stores the sheet 410 in a sheet bending area 200 provided in the conveyance buffer apparatus 20. The sheet bending area 200 is provided in order to absorb bending occurring due to a difference in treatment speed between the pretreatment apparatus 30 and the image forming apparatus 10 to be described later.

For example, if the image forming apparatus 10 is of a type that serially performs printing on the sheet 410, the sheet 410 is intermittently conveyed. If the pretreatment apparatus 30 linearly performs the surface treatment in the main-scanning direction, the sheet 410 needs to be conveyed at a constant speed in an image forming area in which the sheet 410 is printed so as to inhibit uneven treatment to the sheet 410.

Thus, the required methods for sheet feeding in the image forming apparatus 10 and the pretreatment apparatus 30 differ, so that a difference occurs in the treatment speed, causing the sheet 410 to bend between the image forming apparatus 10 and the pretreatment apparatus 30. That is why the sheet bending area 200 for the sheet 410 is provided between the image forming apparatus 10 and the pretreatment apparatus 30 to retain the sheet 410 and temporarily store the bent portion of the sheet 410.

The sheet bending area 200 of the conveyance buffer apparatus 20 is provided therein with bend forming rollers $\mathbf{202}_1$ to $\mathbf{202}_6$, tension springs $\mathbf{203}_1$ to $\mathbf{203}_6$, and sensors $\mathbf{120}_1$ and $\mathbf{120}_2$ between entrance-side registration rollers 201 and exit-side registration rollers 204. The sheet 410 is fed from the entrance-side registration rollers 201 to the sheet bending area 200, then sequentially travels through the bend forming rollers $\mathbf{202}_1$ to $\mathbf{202}_6$, and is fed from the sheet bending area 200 toward the sheet feeding direction via the exit-side registration rollers 204 to the outside.

The bend forming rollers $\mathbf{202}_1$ to $\mathbf{202}_6$ are supported by the tension springs $\mathbf{203}_1$ to $\mathbf{203}_6$, respectively, which expand and contract according to the amount of bending of the sheet 410 so as to apply an appropriate tension to the sheet 410.

For example, as the amount of the sheet 410 retained in the sheet bending area 200 decreases, the bend forming rollers $\mathbf{202}_1$ to $\mathbf{202}_6$ are more pulled against the tensile forces of the tension springs $\mathbf{203}_1$ to $\mathbf{203}_6$, respectively. When the amount of the sheet 410 retained in the sheet bending area 200 increases, the bend forming rollers $\mathbf{202}_1$ to $\mathbf{202}_6$ are pushed by the sheet 410 against the tensile forces of the tension springs $\mathbf{203}_1$ to $\mathbf{203}_6$, respectively.

The sensors $\mathbf{120}_1$ and $\mathbf{120}_2$ are provided to detect the amount of bending of the sheet 410. The sensors $\mathbf{120}_1$ and $\mathbf{120}_2$ are, for example, optical sensors, each of which includes a light source and a light receiver, and detects a physical body by receiving reflected light of light emitted from the light source at the light receiver. The sensors $\mathbf{120}_1$ and $\mathbf{120}_2$ are not limited to this type, but may be of a type that detects the physical body by directly receiving the light emitted from the light source at the light receiver.

The image forming system 1*a* makes a determination on the amount of bending of the sheet 410 based on the detection results of the sensors $\mathbf{120}_1$ and $\mathbf{120}_2$. If the determination indicates that the amount of bending is excessive, the image forming system 1*a* stops driving the roll 400. This causes the sheet 410 to be given a tension by the conveyance of the sheet 410 by the image forming apparatus 10. Thus, the bending of the sheet 410 is adjusted in the conveyance buffer apparatus 20.

The sheet 410 in the sheet bending area 200 comes out of the sheet bending area 200 through the exit-side registration rollers 204, and then is fed to the image forming apparatus 10. The image forming apparatus 10 intermittently conveys the fed sheet 410 according to the image forming area, and performs printing by forming an image in the image forming area. The image forming apparatus 10 uses, for example, an inkjet method to perform the image formation on the sheet 410. The method for image formation used by the image forming apparatus 10 is not limited to the inkjet method. The image forming apparatus 10 may use, for example, electrophotography in which an electrostatic latent image is formed on a photoconductor drum, and the image is formed by transferring the latent image to the sheet 410. The image forming apparatus 10 discharges the printed sheet 410.

Figure 3:
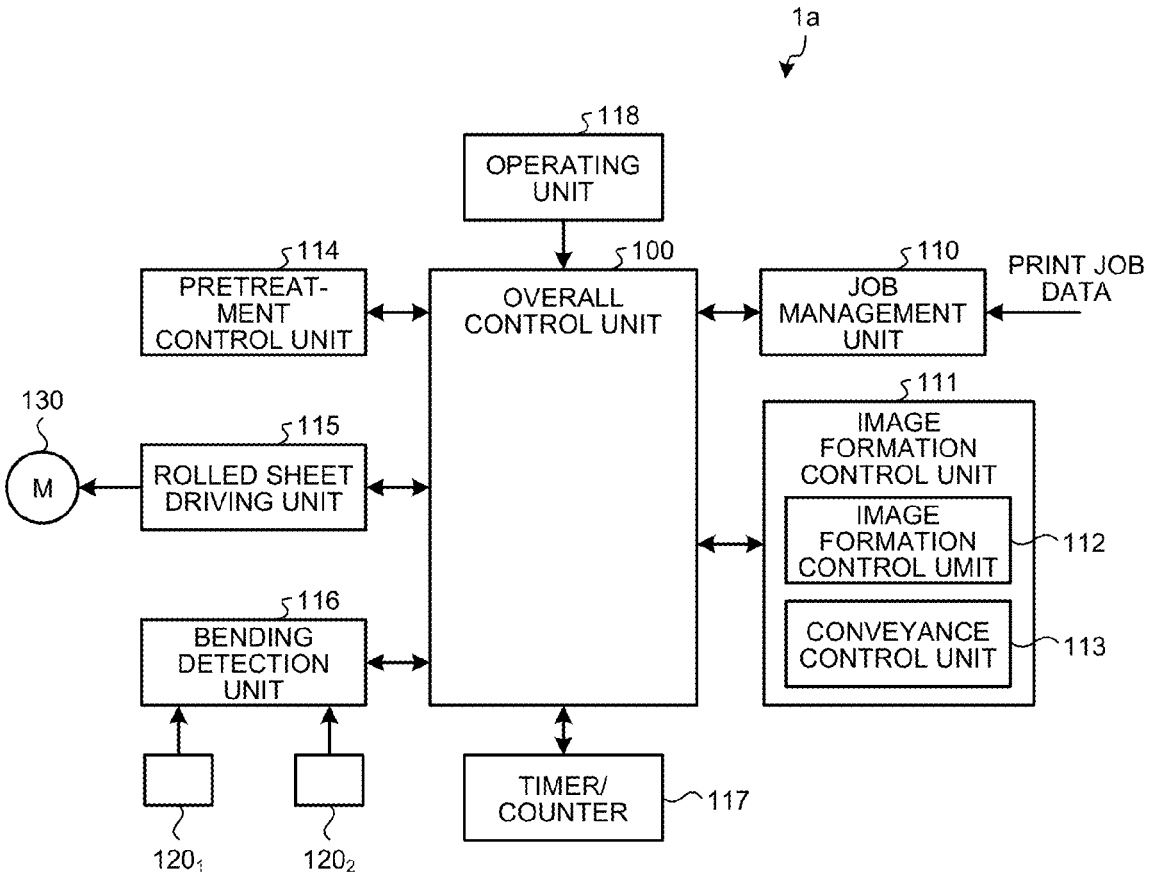
FIG. 3 is a functional block diagram of the example for explaining functions of the image forming system according to the first embodiment.

FIG. 3 illustrates a functional block diagram of the example for explaining functions of the image forming system 1*a* according to the first embodiment. The image forming system 1*a* includes an overall control unit 100, a job management unit 110, an image formation control unit 111, a pretreatment control unit 114, a rolled sheet driving unit 115, a bending detection unit 116, a timer/counter 117, and an operating unit 118.

The overall control unit 100 includes, for example, a central processing unit (CPU), a read-only memory (ROM), and a random access memory (RAM), and the CPU controls the whole operation of the image forming system 1*a* by operating according to a program prestored in the ROM using the RAM as a work memory. The overall control unit 100 is, for example, built into the image forming apparatus 10 in FIG. 1. It is not limited thereto, but the overall control unit 100 may be built into any one of the conveyance buffer apparatus 20, the pretreatment apparatus 30, and the sheet feeding apparatus 40, or may be configured separately from the image forming apparatus 10, the conveyance buffer apparatus 20, the pretreatment apparatus 30, and the sheet feeding apparatus 40.

The job management unit 110 receives print job data output from an external device, such as a computer device, and stores the received print job data. The overall control unit 100 reads the stored print job data. The image formation control unit 111 includes an image formation control unit 112 and a conveyance control unit 113. The conveyance control unit 113 follows a command from the overall control unit 100 to control the conveyance of the sheet 410. The image formation control unit 112 follows a command from the overall control unit 100 to control the image formation on the sheet 410 according to the print job data.

The pretreatment control unit 114 follows a command from the overall control unit 100 to control the operation of the pretreatment apparatus 30. The rolled sheet driving unit 115 follows a command from the overall control unit 100 to control the operation of a motor 130, and thus drive the roll 400 in a specified driving direction. The timer/counter 117 follows a command from the overall control unit 100 to measure time elapsed from a specified time. The operating unit 118 accepts an operation by an operator, and outputs a control signal corresponding to the accepted operation to the overall control unit 100.

The bending detection unit 116 is supplied with outputs of the sensors $\mathbf{120}_1$ and $\mathbf{120}_2$. Based on the supplied outputs of the sensors $\mathbf{120}_1$ and $\mathbf{120}_2$, the bending detection unit 116 makes a determination on the amount of bending of the sheet 410, and feeds the determination result to the overall control unit 100.

The example of FIG. 2 provides the sensors $\mathbf{120}_1$ and $\mathbf{120}_2$ so as to detect the sheet 410 fed from the bend forming roller $\mathbf{202}_6$ toward the exit-side registration rollers 204. In this arrangement, the sensor $\mathbf{120}_1$ is placed at an intermediate part between the bend forming roller $\mathbf{202}_6$ and the exit-side registration rollers 204. The sensor $\mathbf{120}_2$ is provided in a position below the sensor $\mathbf{120}_1$, such as a position corresponding to the upper limit of a moving range of the tension spring $\mathbf{203}_6$ supporting the bend forming roller $\mathbf{202}_6$ (a position where the tension spring $\mathbf{203}_6$ is most contracted).

The bending detection unit 116 can make the determination on the amount of bending of the sheet 410 based on, for example, three states in the sensors $\mathbf{120}_1$ and $\mathbf{120}_2$ indicated as the following states 1 to 3, where the amount of bending is the largest in the state 1, and the smallest in the state 3.

1. Both the sensors $\mathbf{120}_1$ and $\mathbf{120}_2$ detect the sheet 410.
2. Only the sensor $\mathbf{120}_1$ detects the sheet 410.
3. Neither of the sensors $\mathbf{120}_1$ and $\mathbf{120}_2$ detects the sheet 410.

As an example, in the state of FIG. 2, the bend forming roller $\mathbf{202}_6$ is positioned below the sensor $\mathbf{120}_2$, so that both the sensors $\mathbf{120}_1$ and $\mathbf{120}_2$ detect the sheet 410. In this case, the bending detection unit 116 determines, for example, that the amount of bending is excessive.

Reducing the amount of bending of the sheet 410 from the state of FIG. 2 causes the sheet 410 to pull up the bend forming roller $202_6$, and the bend forming roller $202_6$ first passes through the position of the sensor $120_2$. This causes the sheet 410 to be detected by the sensor $120_1$ alone. In this case, the bending detection unit 116 determines, for example, that the amount of bending is appropriate.

Further reduction in the amount of bending of the sheet 410 further pulls up the bend forming roller $202_6$, and, as a result, both the sensors $120_1$ and $120_2$ no longer detect the sheet 410. In this case, the bending detection unit 116 determines, for example, that the amount of bending is insufficient.

If the amount of feed of the sheet 410 is excessively larger than the amount of feed of the sheet in the image forming apparatus 10, the tension springs $203_1$ to $203_6$ are pushed by the sheet 410 by an amount exceeding the moving range, so that the sheet 410 excessively bends. Based on the detection results of the sensors $120_1$ and $120_2$, the image forming system 1*a* determines whether the sheet 410 has excessively bent.

For example, if both the sensors $120_1$ and $120_2$ detect the sheet 410, the bending detection unit 116 determines that the sheet 410 has excessively bent, and the image forming system 1*a* stops driving the roll 400. This causes the sheet 410 to be given a tension by the conveyance of the sheet 410 by the image forming apparatus 10. Thus, the bending of the sheet 410 is adjusted in the conveyance buffer apparatus 20.

In the configuration described above, the job management unit 110 receives and stores the print job data created by, for example, the external computer device. Beforehand, the sheet 410 is drawn from the roll 400, then is fed from the exit-side registration rollers 204 after passing through the inside of the pretreatment apparatus 30 and the conveyance buffer apparatus 20 in a predetermined manner, and is set in the image forming apparatus 10.

After an operation to start printing is performed on the operating unit 118, the overall control unit 100 reads the job data from the job management unit 110. The overall control unit 100 commands the rolled sheet driving unit 115 to feed the sheet 410 in the sheet feeding direction. The overall control unit 100 also commands the pretreatment control unit 114 to perform the surface treatment on the sheet 410. The overall control unit 100 further commands the conveyance control unit 113 to convey the sheet 410.

After the conveyance control unit 113 controls the image forming area to be conveyed into a predetermined position after the sheet 410 has been surface-treated in the pretreatment apparatus 30, the overall control unit 100 commands the image formation control unit 112 to form the image according to the print job data read from the job management unit 110. According to this command, an image is formed on the sheet 410 under the control of the image formation control unit 112 and the printing is thus performed.

Method for Control of Printing Operation According to First Embodiment

The first embodiment employs a surface treatment method that modifies the surface of the sheet 410 by plasma-treating the surface. With this surface treatment method, the sheet surface is improved in hydrophilicity and permeability and reduced in pH by the surface treatment, so that, when ink used for the image formation has landed on the sheet 410, the sheet 410 quickly absorbs a liquid component thereof, and the ink is quickly aggregated, whereby higher image quality is obtained.

The hydrophilicity of the sheet surface provided by the plasma treatment is known to be degraded by being left as it is. In addition, the pH value of the sheet surface is known to be increased by being left as it is. These natures require the time after the sheet is surface-treated until the image is formed to be within a certain time; performing the image formation after the certain time is exceeded reduces the effect of the surface treatment, and makes it impossible to obtain a desired high-quality image.

Hence, in the image forming system 1*a* according to the first embodiment, if the image is not formed in a surface-treated region of the sheet 410 within a predetermined time after the sheet 410 is surface-treated in the pretreatment apparatus 30, the sheet 410 is returned so that the surface-treated region reaches a position at least before the pretreatment apparatus 30. The sheet 410 is then fed in the sheet feeding direction, and is surface-treated again in the pretreatment apparatus 30; the image forming apparatus 10 thereafter performs the image formation.

Figure 4:
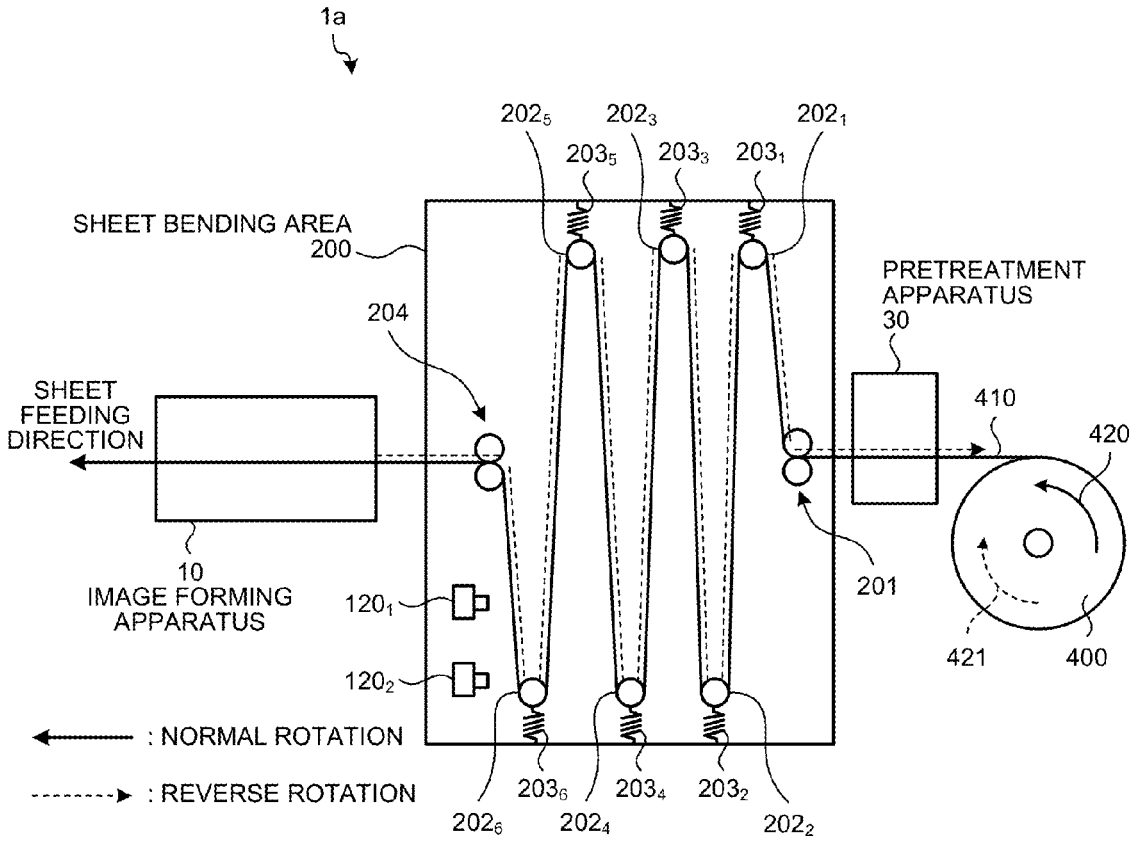
FIG. 4 is a diagram for more specifically explaining a control method for a printing operation according to the first embodiment.

A more specific description will be given using FIG. 4. In FIG. 4, parts in common with those in FIG. 2 explained above will be given the same reference numerals, and detailed description thereof will be omitted. The rotation direction of the roll 400 for conveying the sheet 410 in the sheet feeding direction is called a normal rotation direction, and is indicated by the arrow 420 in a solid line. The rotation direction of the roll 400 for conveying the sheet 410 in the direction opposite to the sheet feeding direction is called a reverse rotation direction, and is indicated by the arrow 421 in a dotted line. Driving the roll 400 in the normal rotation direction feeds the sheet 410 out of the roll 400, and driving the roll 400 in the reverse rotation direction rewinds the sheet 410 onto the roll 400.

As an example, consider a case in which a print operation (called a print job operation) according to previous print job data causes the pretreatment apparatus 30 to perform the surface treatment once on a region of the sheet 410 indicated by a dotted line in FIG. 4, that is, a region up to immediately before the image forming apparatus 10, and then the state of the sheet 410 is left as it is for some reason. A power-off operation of the image forming system 1*a* is a possible cause by which the state of the sheet 410 is left as it is.

If the next print job operation begins after the predetermined time or longer has elapsed since the state of the sheet 410 was left as it was, the image forming system 1*a* first reversely rotates the roll 400 to rewind the region of the sheet 410 surface-treated in the previous print job operation (region indicated by the dotted line in FIG. 4) onto the roll 400. The image forming system 1*a* then normally rotates the roll 400 to convey the rewound sheet 410 in the sheet feeding direction and perform the surface treatment again on the sheet 410 in the pretreatment apparatus 30, and thereafter, feeds the sheet 410 via the conveyance buffer apparatus 20 to the image forming apparatus 10 to perform the image formation.

Thus, by performing the surface treatment and the image formation on the sheet 410 in the series of successive sheet conveyance operations, the effect of the surface treatment is more appropriately provided, and high-quality image formation can be performed.

While the above description has explained that the power-off operation of the image forming system 1*a* is the cause of the elapse of the predetermined time after the pretreatment apparatus 30 has performed the surface treatment until the image forming apparatus 10 performs the image formation, the cause is not limited to this example. Other examples of possible causes of the elapse of the predetermined time from the surface treatment until the image formation include, but are not limited to, a sheet conveyance jam during the print job operation and a trouble in the image forming apparatus 10. In these cases, the print job operation is resumed after the problem is solved. When resuming the print job operation after the problem is solved, the first embodiment once rewinds the sheet 410 onto the roll 400, and then conveys the sheet 410 in the sheet feeding direction to perform the surface treatment again with the pretreatment apparatus 30, as described above.

For example, the time described below can be employed as the above-mentioned predetermined time for determining whether to rewind the sheet 410 and surface-treat it again. Specifically, the image forming system 1*a* can employ, as the predetermined time, a time required for the series of operations in which, after a region of the sheet 410 is surface-treated, the sheet 410 is fed to the image forming apparatus 10 through the sheet bending area 200, and the image is formed on the region.

The time required for the series of operations varies depending on the amount (amount of bending) of the sheet 410 stored in the sheet bending area 200. Specifically, the time required for the series of operations increases as the amount of bending of the sheet 410 in the sheet bending area 200 increases. Hence, for example, the longest allowable time for the series of operations may be employed as the predetermined time. The longest allowable time for the series of operations can be, for example, a value determined by the upper limit of the amount of the sheet 410 storable in the sheet bending area 200. The longest allowable time for the series of operations is not limited to this value, but may also be the longest time for which the effect of the surface treatment by the pretreatment apparatus 30 is sustained.

The predetermined time is not limited to the above example, but the image forming system 1*a* can vary the predetermined time depending on the type of the sheet 410. For example, in the case of a sheet (medium) having a synthetic resin-based material, such as a film, as the base material, decrease of the effect of the surface treatment with time is known to be smaller than in the case of a sheet having paper, such as plain paper or coated paper, as the base material. Consequently, in the case of using the sheet having, for example, a film as the base material as the sheet 410, the predetermined time can be changed to a longer time than in the case of using the sheet having paper as the base material as the sheet 410.

The image forming system 1*a* can also vary the predetermined time according to the current environment in which the image forming system 1*a* operates. For example, the image forming system 1*a* may set the predetermined time according to the ambient humidity in the operating environment. Specifically, decrease of the effect of the surface treatment with time is known to be smaller as the ambient humidity is lower. Hence, by providing a measurement unit for measuring the ambient humidity at a part of the image forming system 1*a* (such as in the sheet bending area 200) related to the conveyance of the sheet 410, the predetermined time can be changed according to the humidity measured by the measurement unit.

More specifically, for example, if the humidity measured by the measurement unit is higher than a threshold, the image forming system 1*a* sets the predetermined time to the above-described time required for the series of operations in which the surface treatment and the image formation is performed on the particular region of the sheet 410; if, instead, the measured humidity is lower than the threshold, the image forming system 1*a* changes the predetermined time to a time longer than the above-described time.

While, in the above description, the image forming system 1*a* performs the surface treatment again in the pretreatment apparatus 30 after the predetermined time has elapsed by reversely rotating the roll 400 to once rewind the sheet 410, and then normally rotating the roll 400 to feed the sheet 410 in the sheet feeding direction, the method of performing the surface treatment again is not limited to this example. For example, the image forming system 1*a* may perform the surface treatment again on the sheet 410 while rewinding the sheet 410 by reversely rotating the roll 400.

In addition, while the above description has given the plasma treatment, the corona treatment, the heat treatment, and the pressure treatment as examples of the pretreatment performed by the pretreatment apparatus 30, the pretreatment is not limited to these examples. Specifically, the pretreatment apparatus 30 may perform any pretreatment having the effect that is reduced by being left as it is.

Figure 5:
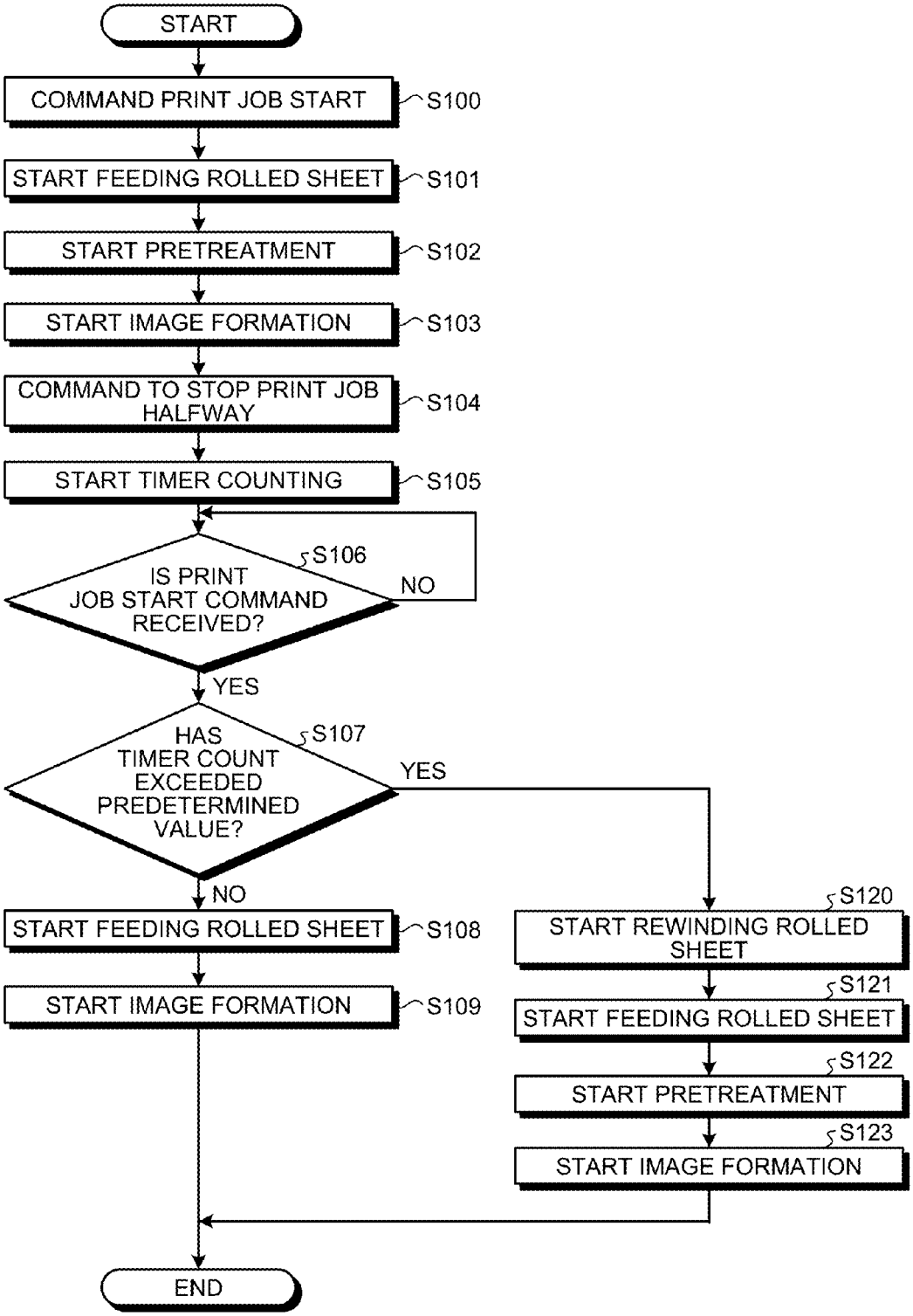
FIG. 5 is a flowchart illustrating the operation of the example of the image forming system according to the first embodiment.

FIG. 5 is a flowchart illustrating the operation of the example of the image forming system 1*a* according to the first embodiment. Before the processing according to the flowchart in FIG. 5, the print job data for specifying the print job is sent from the external computer device to the image forming system 1*a*. This print job data is stored and managed in the job management unit 110. The operator performs the operation to start the print job, for which data is stored in the job management unit 110, on the operating unit 118.

At Step S100, the overall control unit 100 of the image forming system 1*a* receives, from the operating unit 118, a command to start the print job that has been output according to the operation of the operator. At the next Step S101, according to the received print job start command, the overall control unit 100 issues a command to the rolled sheet driving unit 115 to rotationally drive the roll 400 in the normal rotation direction (in the direction of the arrow 420), and thus starts the feed of the roll 400 in the sheet feeding direction. The sheet 410 is fed from the sheet feeding apparatus 40 and supplied to the pretreatment apparatus 30.

Then, at Step S102, the overall control unit 100 commands the pretreatment control unit 114 to start the surface treatment to the sheet 410. The pretreatment control unit 114 follows this command to control the pretreatment apparatus 30 to perform the predetermined surface treatment on the sheet 410 passing through the pretreatment apparatus 30, and to feed the sheet 410 out of the pretreatment apparatus 30 in the sheet feeding direction.

Then, at Step S103, the overall control unit 100 commands the image formation control unit 111 to start the image formation on the sheet 410 according to the print job data.

As described above, the sheet 410 fed from the pretreatment apparatus 30 is fed to the conveyance buffer apparatus 20. In the conveyance buffer apparatus 20, the sheet 410 travels through the entrance-side registration rollers 201 and then through the bend forming rollers $\mathbf{202}_1$ to $\mathbf{202}_6$ in the sheet bending area 200, and the tension of the sheet is adjusted to a predetermined level. After passing through the bend forming rollers $\mathbf{202}_1$ to $\mathbf{202}_6$, the sheet 410 is conveyed out of the conveyance buffer apparatus 20 through the exit-side registration rollers 204. The sheet 410 conveyed out of the conveyance buffer apparatus 20 is fed to the image forming apparatus 10. The image formation control unit 111 uses the conveyance control unit 113 to control the sheet 410 to be conveyed at a predetermined conveying speed in the image forming apparatus 10. The image formation control unit 111 also uses the image formation control unit 112 to perform control to perform printing by forming the image according to the print job data on the sheet 410 conveyed by the control of the conveyance control unit 113.

At this time, the image formation control unit 111 may start the image formation after the region of the sheet 410 surface-treated in the pretreatment apparatus 30 has reached the image forming apparatus 10, or may start the image formation regardless of whether the surface treatment has been performed. If the image is formed on a portion of the sheet 410 located in a region that is not surface-treated, the portion is, for example, discarded.

Suppose, as illustrated in Step S104, that a command to stop the print job that has been started by the command at Step S100 is issued, for example, by the operator through an operation on the operating unit 118 before the print job is completed, that is, in the middle of the print job. The overall control unit 100 follows this print job stop command to stop the print job, for example, by stopping the operation of the image forming system 1*a*.

For example, the overall control unit 100 commands the rolled sheet driving unit 115 to stop rotationally driving the roll 400, and commands the pretreatment control unit 114 to stop the surface treatment in the pretreatment apparatus 30. The overall control unit 100 also commands the image formation control unit 111 to stop the conveyance of the sheet 410 by the control of the conveyance control unit 113 and the image formation by the control of the image formation control unit 112.

At the next Step S105, the overall control unit 100 commands the timer/counter 117 to start counting time with a timer. The timer/counter 117 follows this command to reset the count value and start the counting of the timer.

At the next Step S106, the overall control unit 100 determines whether a print job start command is received from the operating unit 118. The print job start command may be a start command for starting the print job according to the print job data that has been sent from the external computer device and stored in the job management unit 110 before the process at Step S100 described above. The print job start command is not limited to this command, but may be a start command for starting the print job according to another print job data that has been sent from the external computer device between Step S104 and Step S106.

If Step S106 determines that the print job start command is not received, the overall control unit 100 waits again for the print job start command at Step S106.

If Step S106 determines that the print job start command is received, the overall control unit 100 performs processing at Step S107. At Step S107, the overall control unit 100 determines whether the count value of the timer/counter 117 exceeds a predetermined value representing the predetermined time described above. If not at Step S107, the overall control unit 100 performs processing at Step S108.

At Step S108, in the same manner as at Step S101 described above, the overall control unit 100 issues a command to the rolled sheet driving unit 115 to rotationally drive the roll 400 in the normal rotation direction (in the direction of the arrow 420), and thus starts the feed of the roll 400 in the sheet feeding direction. At the next Step S109, the overall control unit 100 commands the image formation control unit 111 to start the image formation on the sheet 410 according to the print job data.

At Step S108, the sheet 410 that has been stored in the conveyance buffer apparatus 20 by the operation up to immediately before Step S104 is fed from the conveyance buffer apparatus 20, and supplied to the image forming apparatus 10. At Step S109, the image forming apparatus 10 performs printing on the sheet 410 according to the print job data. Then, the series of processes according to the flowchart in FIG. 5 end.

If Step S107 described above determines that the count value of the timer/counter 117 exceeds the predetermined value, the overall control unit 100 performs processing at Step S120. At Step S120, the overall control unit 100 issues a command to the rolled sheet driving unit 115 to rotationally drive the roll 400 in the reverse rotation direction (in the direction of the arrow 421), and thus starts the rewind of the sheet 410 onto the roll 400. After a predetermined amount of the sheet 410 is rewound onto the roll 400, the overall control unit 100 performs processing at Step S121.

The overall control unit 100 can determine whether the amount of the sheet 410 rewound onto the roll 400 has reached the predetermined amount, for example, according to the determination result on the amount of bending made by the bending detection unit 116 based on the outputs of the sensors $\mathbf{120}_1$ and $\mathbf{120}_2$.

Suppose, as an example, that the print job is stopped halfway while both the sensors $\mathbf{120}_1$ and $\mathbf{120}_2$ are detecting the sheet 410 at Step S104 described above. When the sheet 410 starts to be rewound onto the roll 400 from this state, the sheet 410 pulls the bend forming rollers $\mathbf{202}_1$ to $\mathbf{202}_6$ in the direction opposite to the tension springs $\mathbf{203}_1$ to $\mathbf{203}_6$, respectively, (toward the inside of the sheet bending area 200 in the example of FIG. 4) according to the rewound amount of the sheet 410.

In this state, if, for example, the bend forming roller $\mathbf{202}_6$ is pulled beyond the sensor $\mathbf{120}_2$ and up to above the sensor $\mathbf{120}_1$, both the sensors $\mathbf{120}_1$ and $\mathbf{120}_2$ no longer detect the sheet 410. After Step S120 has started the rewind of the sheet 410 onto the roll 400, if the bending detection unit 116 supplies a detection result that neither of the sensors $\mathbf{120}_1$ and $\mathbf{120}_2$ detects the sheet 410, and hence the amount of bending is insufficient, the overall control unit 100 performs the processing at Step S121.

The determination criterion is not limited to this example, but the overall control unit 100 may perform the processing at Step S121 if a certain time has elapsed after the sheet 410 has started to be rewound onto the roll 400 at Step S120.

At Step S121, in the same manner as at Step S101 described above, the overall control unit 100 issues a command to the rolled sheet driving unit 115 to rotationally drive the roll 400 in the normal rotation direction, and thus starts the feed of the roll 400 in the sheet feeding direction. At the next Step S122, in the same manner as at Step S102 described above, the overall control unit 100 commands the pretreatment control unit 114 to start the surface treatment to the sheet 410. The pretreatment control unit 114 follows this command to control the pretreatment apparatus 30 to perform the predetermined surface treatment on the sheet 410 passing through the pretreatment apparatus 30, and to feed the sheet 410 out of the pretreatment apparatus 30 in the sheet feeding direction.

At the next Step S123, in the same manner as at Step S103 described above, the overall control unit 100 commands the image formation control unit 111 to start the image formation on the sheet 410 according to the print job data. The image formation control unit 111 performs control to perform printing by forming the image on the sheet 410 according to the print job data in the manner described above.

As described above, in the configuration in which the sheet 410 is pretreated, and, after being once stored in the conveyance buffer apparatus 20, the pretreated sheet 410 is fed from the image forming apparatus 10 and is subjected to the image formation, stopping the print operation according to the print job halfway causes the pretreated sheet 410 to be retained in the conveyance buffer apparatus 20, and thus reduces the effect obtained by the pretreatment.

According to the first embodiment, after the print operation according to the print job is stopped halfway and the pretreated sheet 410 is retained in the conveyance buffer apparatus 20, the print operation according to the next print job is started by once rewinding the retained pretreated sheet 410 onto the roll 400, feeding the rewound sheet 410 out of the roll 400 and pretreating it again, and feeding the pretreated sheet 410 to the image forming apparatus 10 via the conveyance buffer apparatus 20. As a result, by use of the method for controlling the printing operation according to the first embodiment, the sheet 410 is appropriately pretreated, so that a high-quality printed image can be obtained.

If the image forming apparatus 10 performs the image formation using the inkjet method, performing the pretreatment again on the retained sheet 410 allows the reduction of the amount of attached ink, and further, in a system using a drying heater, allows the reduction of the heater energy.

Modification of First Embodiment

Figure 6:
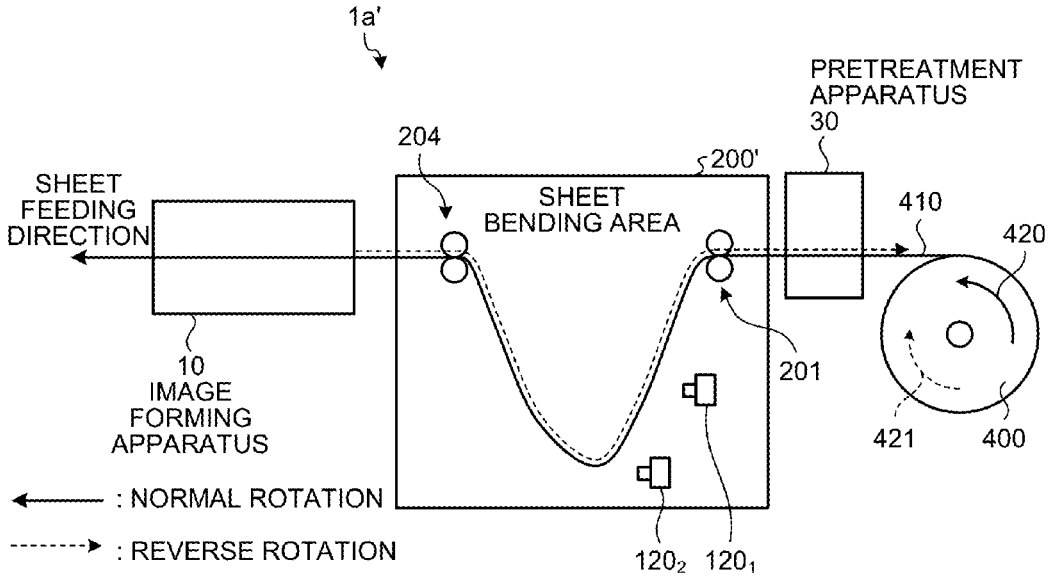
FIG. 6 is a diagram illustrating more in detail an example of the configuration of an image forming system according to a modification of the first embodiment, with a focus on the conveyance buffer apparatus.

A modification of the first embodiment will be described. FIG. 6 illustrates more in detail an example of the configuration of an image forming system 1*a*' according to a modification of the first embodiment, with a focus on the conveyance buffer apparatus 20. In FIG. 6, parts in common with those in FIG. 4 explained above will be given the same reference numerals, and detailed description thereof will be omitted. The image forming system 1*a*' according to the modification of the first embodiment has the same functions as the functions described using FIG. 3, and the operation of the image forming system 1*a*' is the same as the operation described using FIG. 5, so that descriptions of the functions and the operation will be omitted.

As described using FIGS. 2 and 4, the first embodiment described above uses the bend forming rollers $\mathbf{202}_1$ to $\mathbf{202}_6$ provided in the sheet bending area 200 to adjust the bending of the sheet 410 caused by the difference between the treatment speed in the pretreatment apparatus 30 and the treatment speed by the image forming apparatus 10. As illustrated in FIG. 6, the modification of the first embodiment is not provided with the bend forming rollers in a sheet bending area 200', and lets the sheet 410 bend naturally between the entrance-side registration rollers 201 and the exit-side registration rollers 204.

In a manner similar to the first embodiment described above, the modification of the first embodiment is provided with the sensors $\mathbf{120}_1$ and $\mathbf{120}_2$ for detecting the sheet 410, the sensor $\mathbf{120}_2$ being provided in a lower position, and the sensor $\mathbf{120}_1$ being provided between the sensor $\mathbf{120}_2$ and the entrance-side registration rollers 201. The image forming system 1*a*' according to the modification of the first embodiment detects which state of the above-described states 1 to 3 is indicated by the outputs of the sensors $\mathbf{120}_1$ and $\mathbf{120}_2$, and makes a determination on the amount of bending of the sheet 410. In the same manner as in the case of the first embodiment, the image forming system 1*a*' halts the feeding of the roll 400 if the amount of bending is determined to be excessive, and resumes the feeding of the roll 400 if the amount of bending is determined to be insufficient to adjust the amount of bending of the sheet 410.

In the configuration described above, the image forming system 1*a*' pretreats the sheet 410 in the pretreatment apparatus 30, and, after once storing the pretreated sheet 410 in the conveyance buffer apparatus 20, feeds the pretreated sheet 410 to the image forming apparatus 10 to perform the image formation. If the print operation according to the print job is stopped halfway and the pretreated sheet 410 is retained in the conveyance buffer apparatus 20 for the predetermined time or longer, the image forming system 1*a*' once rewinds the sheet 410 onto the roll 400 at the start of the next printing operation. The image forming apparatus 1*a*' then feeds the rewound sheet 410 out of the roll 400 and pretreats the sheet 410 in the pretreatment apparatus 30 again, and feeds the sheet 410 to the image forming apparatus 10 via the sheet bending area 200'.

As a result, also according to the modification of the first embodiment, the sheet 410 is appropriately pretreated, so that a high-quality printed image can be obtained.

Second Embodiment

A second embodiment of the present invention will be described. In the second embodiment, a description will be given more in detail of the plasma treatment that is employed as the pretreatment for the print processing in the image forming system 1*a* according to the first embodiment described above. To aggregate ink pigments while preventing the pigments from dispersing immediately after the ink has landed on the treatment object (also called the recording medium or the printing medium), the surface of the treatment object is acidified. The plasma treatment is used as a method for the acidification.

In the plasma treatment as the acidification treatment method (process), the treatment object is irradiated with plasma in the atmosphere so as to cause polymers on surface of the treatment object to react to generate hydrophilic functional groups. Specifically, electrons e discharged from a discharge electrode are accelerated in an electric field, and excite and ionize atoms and molecules in the atmosphere. The ionized atoms and molecules also discharge electrons, thus increasing high-energy electrons, resulting in generation of a streamer discharge (plasma). The high-energy electrons produced by the streamer discharge cut off polymer bonds on the surface of the treatment object (such as the coated paper) (the coating layer of the coated paper is solidified with calcium carbonate and starch as a binder, and the starch has a polymeric structure), and the cut-off polymers recombine with oxygen radical O*, hydroxyl radical (—OH), and ozone $O_3$ in the gaseous phase. These processes are called the plasma treatment. This treatment generates polar functional groups, such as a hydroxyl group and a carboxyl group, on the surface of the treatment object. As a result, hydrophilicity and acidity are given to the surface of the treatment object. The increase in the amount of carboxyl group acidifies (reduces the pH value of) the surface of the printing medium.

To prevent color mixture between dots due to wet spreading and coalescence of adjacent dots on the treatment object caused by an increase in the hydrophilicity, it has been found important to aggregate colorants (such as pigments or dyes) in the dots, or to dry vehicles or make the vehicles permeate the treatment object before the vehicles wet-spread. Hence, the present embodiment performs the acidification treatment of acidifying the surface of the treatment object as the pretreatment for the inkjet recording processing.

The acidification in the present invention means to reduce the pH value of the surface of the printing medium to a pH value at which the pigments contained in the ink are aggregated. Reducing the pH value means to increase the concentration of hydrogen ion $H^+$ in a physical body. The pigments contained in the ink before coming into contact with the surface of the treatment object are negatively charged, and are dispersed in the vehicles. The viscosity of the ink increases as the pH value thereof decreases. This is because the negatively charged pigments in the vehicles of the ink are electrically neutralized with the increase in the acidity of the ink, and as a result, the pigments are aggregated with each other. Accordingly, the viscosity of the ink can be increased by reducing the pH value of the surface of the printing medium so that the pH value of the ink reaches a value corresponding to the required viscosity. This is because, when the ink adheres to the acid surface of the printing medium, the pigments are electrically neutralized by hydrogen ion $H^+$ on the surface of the printing medium, and are thereby aggregated with each other. This increase in the ink viscosity can prevent the color mixture between adjacent dots, and can prevent the pigments from permeating to the deep inside (or even to the backside) of the printing medium. It should be noted that reducing the pH value of the ink to the pH value corresponding to the required viscosity requires setting the pH value of the surface of the printing medium to a value lower than the pH value of the ink corresponding to the required viscosity.

The pH value for obtaining required viscosity of the ink varies depending on the property of the ink. Specifically, in some types of ink, the pigments are aggregated and the viscosity of the pigments increases at a relatively near-neutral pH value, whereas in other types of ink, aggregating the pigments requires a pH value lower than that of the aforementioned types of ink.

The behavior of aggregation of the colorants in dots, the drying speed of the vehicles, and the permeation speed of the vehicles into the treatment object vary depending on, for example, the droplet amount that varies with the dot size (small droplets, medium droplets, or large droplets) and the type of the treatment object. Hence, in the present embodiment, the amount of plasma energy in the plasma treatment may be controlled to an optimal value according to, for example, the type of the treatment object and/or the print mode (droplet amount).

Figure 7:
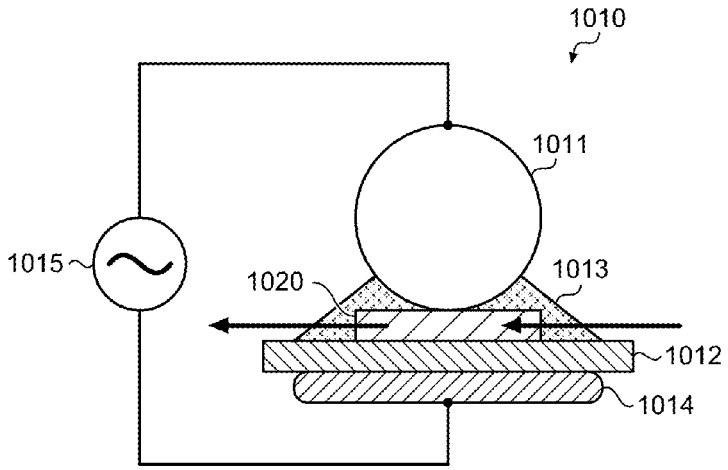
FIG. 7 is an outline diagram illustrating an example of a plasma treatment apparatus according to a second embodiment of the present invention.

FIG. 7 is a schematic diagram for explaining the outline of the acidification treatment employed in the second embodiment. As illustrated in FIG. 7, the acidification treatment employed in the second embodiment uses a plasma treatment apparatus 1010 that includes a discharge electrode 1011, a counter electrode 1014, a dielectric material 1012, and a high-frequency high-voltage power supply 1015. In the plasma treatment apparatus 1010, the dielectric material 1012 is interposed between the discharge electrode 1011 and the counter electrode 1014. Each of the discharge electrode 1011 and the counter electrode 1014 may be an electrode with a metal portion thereof exposed, or an electrode coated with a dielectric material or an insulating material made of, for example, insulating rubber or ceramic. The dielectric material 1012 interposed between the discharge electrode 1011 and the counter electrode 1014 may be an insulating material made of, for example, polyimide, silicon, or ceramic. If corona discharge is employed as the plasma treatment, the dielectric material 1012 may be omitted. However, the dielectric material 1012 is preferably provided in some cases, such as when dielectric barrier discharge is employed. In that case, a larger creeping discharge area is obtained by positioning the dielectric material 1012 close to or in contact with the counter electrode 1014 than close to or in contact with the discharge electrode 1011, and the larger creeping discharge area can lead to a higher effect of the plasma treatment. The discharge electrode 1011 and the counter electrode 1014 (or the dielectric material 1012 instead of the electrode on which the dielectric material 1012 is provided) may be disposed in positions in contact with a treatment object 1020 passing between the two electrodes, or may be disposed in positions not in contact with the treatment object 1020.

The high-frequency high-voltage power supply 1015 applies a high-frequency high-voltage pulse voltage between the discharge electrode 1011 and the counter electrode 1014. The value of the pulse voltage is, for example, approximately 10 kilovolts peak-to-peak (kV p-p). The frequency of the pulse voltage can be set to, for example, approximately 20 kilohertz (kHz). Supplying the high-frequency high-voltage pulse voltage between the two electrodes generates atmospheric pressure non-equilibrium plasma 1013 between the discharge electrode 1011 and the dielectric material 1012. The treatment object 1020 passes between the discharge electrode 1011 and the dielectric material 1012 while the atmospheric pressure non-equilibrium plasma 1013 is being generated. Thereby, a surface of the treatment object 1020 facing the discharge electrode 1011 is subjected to the plasma treatment.

The plasma treatment apparatus 1010 illustrated in FIG. 7 employs the rotary discharge electrode 1011 and the belt-conveyor type dielectric material 1012. The treatment object 1020 passes through a zone of the atmospheric pressure non-equilibrium plasma 1013 by being conveyed while being held between the rotating discharge electrode 1011 and the dielectric material 1012. This causes the surface of the treatment object 1020 to come in contact with the atmospheric pressure non-equilibrium plasma 1013, and thus to be uniformly plasma-treated. The plasma treatment apparatus employed in the present embodiment is not limited to have the configuration illustrated in FIG. 7. The plasma treatment apparatus can have various modified configurations, such as a configuration in which the discharge electrode 1011 is close to, but not in contact with, the treatment object 1020 and a configuration in which the discharge electrode 1011 is mounted on the same carriage as that of an inkjet head. The plasma treatment apparatus can employ the flat-plate type dielectric material 1012 without being limited to the belt-conveyor type dielectric material 1012.

Figure 8:
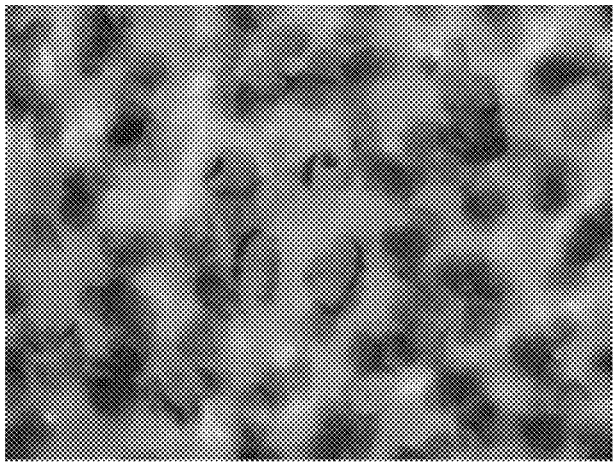
FIG. 8 is an enlarged view of an image obtained by capturing an image of an image forming surface of a printed product obtained by performing inkjet recording processing on a treatment object that has not been subjected to the plasma treatment according to the second embodiment.
Figure 9:
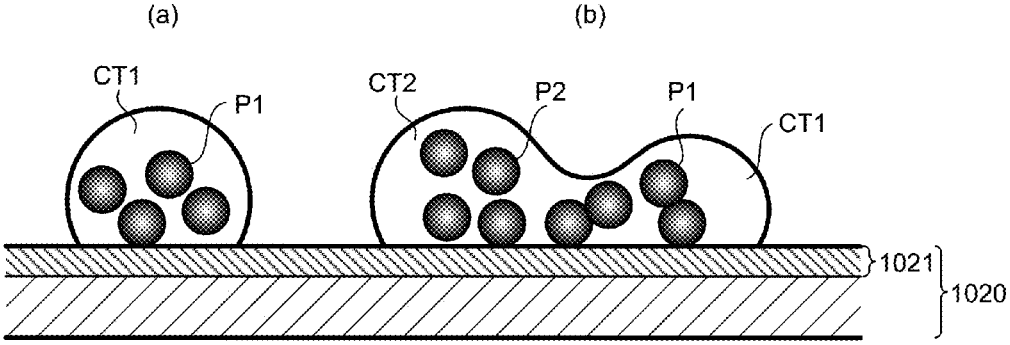
FIG. 9 is a schematic diagram illustrating an example of dots formed on the image forming surface of the printed product illustrated in FIG. 8.
Figure 10:
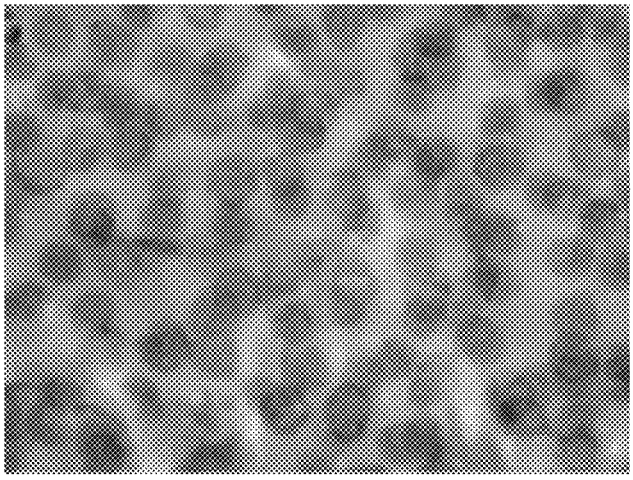
FIG. 10 is an enlarged view of an image obtained by capturing an image of an image forming surface of another printed product obtained by performing the inkjet recording processing on a treatment object that has been subjected to the plasma treatment according to the second embodiment.
Figure 11:
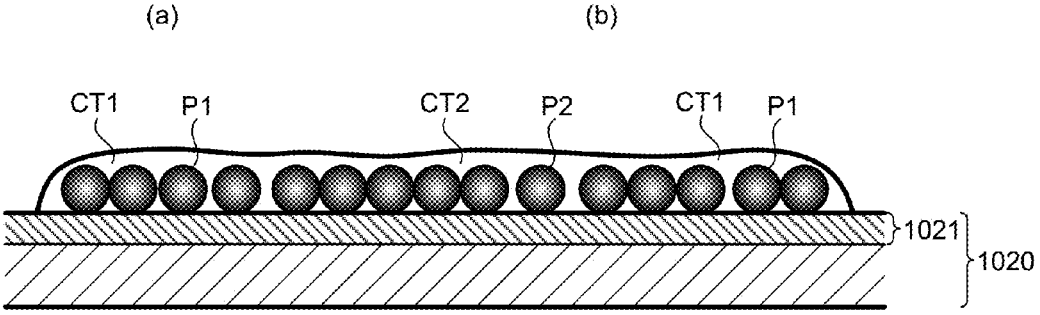
FIG. 11 is a schematic diagram illustrating an example of dots formed on the image forming surface of the printed product illustrated in FIG. 10.

Using FIGS. 8 to 11, a description will be given of a difference in the printed product between the case of performing the plasma treatment according to the second embodiment and the case of not performing the plasma treatment. FIG. 8 is an enlarged view of an image obtained by capturing an image of the image forming surface of a printed product obtained by performing the inkjet recording processing on the treatment object that has not been subjected to the plasma treatment according to the present embodiment, and FIG. 9 is a schematic diagram illustrating an example of dots formed on the image forming surface of the printed product illustrated in FIG. 8. FIG. 10 is an enlarged view of an image obtained by capturing an image of the image forming surface of another printed product obtained by performing the inkjet recording processing on the treatment object that has been subjected to the plasma treatment according to the present embodiment, and FIG. 11 is a schematic diagram illustrating an example of dots formed on the image forming surface of the printed product illustrated in FIG. 10. The printed products illustrated in FIGS. 8 and 10 were obtained using a desktop inkjet recording apparatus. General coated paper having a coating layer was used as the treatment object 1020.

The coated paper not subjected to the plasma treatment according to the second embodiment has low wettability of the coating layer on the surface of the coated paper. Consequently, in the image formed by performing the inkjet recording processing on the coated paper not subjected to the plasma treatment, the shape of a dot (the shape of a vehicle CT1) attached to the surface of the coated paper when the dot has landed thereon is distorted, for example, as illustrated in FIGS. 8 and 9. Moreover, as illustrated in FIGS. 8 and 9, if an adjacent dot is formed while the existing dot is not fully dried, the vehicle CT1 and a vehicle CT2 coalesce with each other when the adjacent dot lands on the coated paper, so that movements (color mixture) of pigments P1 and P2 occur between the dots, and as a result, uneven density may occur due to, for example, beading.

In contrast, the coated paper that has been subjected to the plasma treatment according to the second embodiment has improved wettability of a coating layer 1021 on the surface of the coated paper. Consequently, in the image formed by performing the inkjet recording processing on the coated paper subjected to the plasma treatment, the vehicle CT1 spreads in a relatively flat perfect circular shape on the surface of the coated paper, for example, as illustrated in FIG. 10. This causes the dot to have a flat shape as illustrated in FIG. 11. In addition, the polar functional groups generated by the plasma treatment acidify the surface of the coated paper. As a result, the ink pigments are electrically neutralized, so that the pigments P1 are aggregated and the viscosity of the ink increases. This inhibits the movements (color mixture) of the pigments P1 and P2 between the dots even when the vehicles CT1 and CT2 have coalesced as illustrated in FIG. 11. Furthermore, the polar functional groups are also generated in the coating layer 1021, so that the permeability of the vehicle CT1 increases. This allows the ink to be dried in a relatively short time. The dots that have each spread in a perfect circular shape due to the improved wettability are aggregated while permeating the coated paper, so that the pigments P1 are aggregated uniformly in the height direction, and thereby, the uneven density due to, for example, the beading can be inhibited. FIGS. 9 and 11 are only schematic diagrams, and in reality, in the case illustrated in FIG. 11, the pigments are aggregated into layers.

As described above, in the case of the treatment object 1020 subjected to the plasma treatment according to the second embodiment, the plasma treatment generates the hydrophilic functional groups on the surface of the treatment object 1020, and thereby improves the wettability. The plasma treatment also generates the polar functional groups so as to acidify the surface of the treatment object 1020. As a result of these, the negatively charged pigments are neutralized on the surface of the treatment object 1020 so as to be aggregated to increase the viscosity of the ink while the ink that has landed uniformly spreads on the surface of the treatment object 1020. Thus, the movements of the pigments can be inhibited even when the coalescence of the dots is resulted. The polar functional groups are also generated in the coating layer formed on the surface of the treatment object 1020, so that the vehicles quickly permeate inside of the treatment object 1020, whereby time for drying can be reduced. In other words, the increased wettability spreads each of the dots in the perfect circular shape, and the dots permeate the treatment object 1020 while the aggregation of the pigments inhibits the pigments from moving, so that each of the dots can maintain the nearly perfect circular shape.

Figure 12:
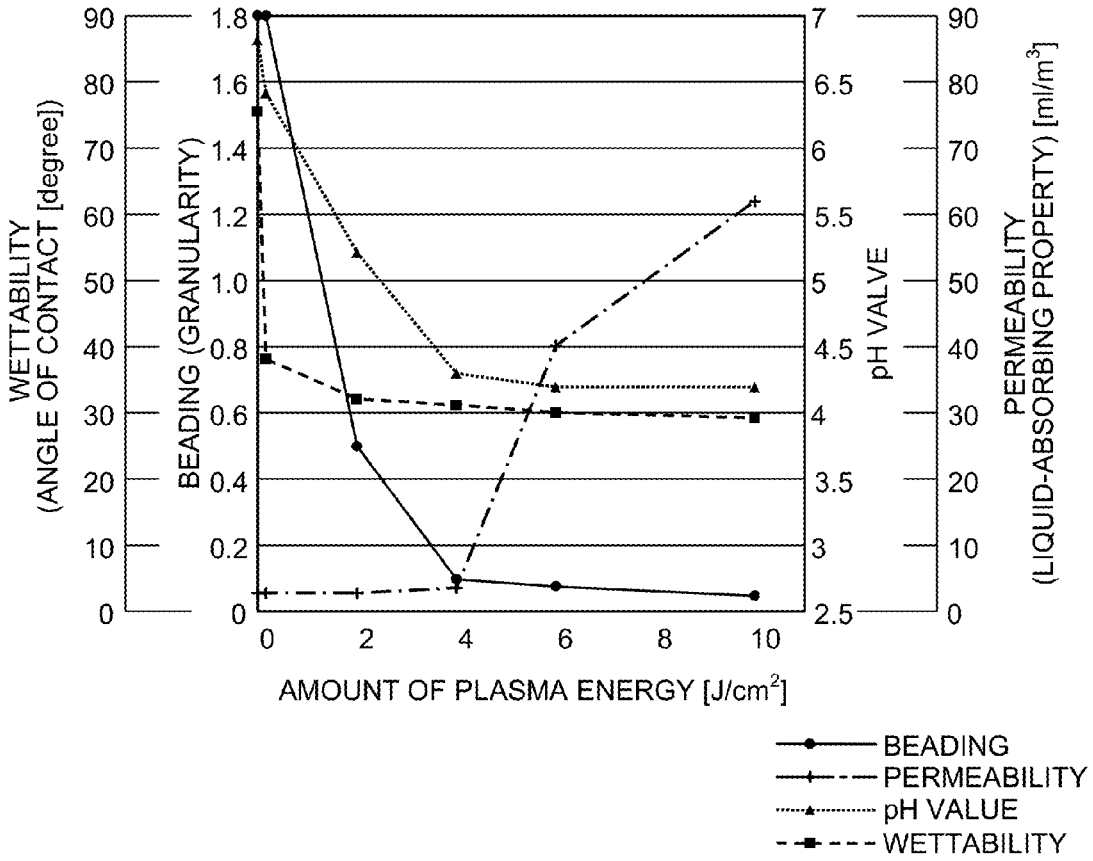
FIG. 12 is a graph illustrating relations of the amount of plasma energy to wettability, beading, pH value, and permeability of a surface of the treatment object according to the second embodiment.

FIG. 12 is a graph illustrating relations of the amount of plasma energy to the wettability, the beading, the pH value, and the permeability of the surface of the treatment object according to the second embodiment. FIG. 12 illustrates how surface properties (wettability, beading, pH Value, and permeability [liquid-absorbing property]) change depending on the amount of plasma energy when the printing is performed on the coated paper serving as the treatment object 1020. The ink used to obtain the evaluation illustrated in FIG. 12 was aqueous pigment ink (alkaline ink in which negatively charged pigments are dispersed) having a property that pigments are aggregated by acid.

As illustrated in FIG. 12, the wettability of the surface of the coated paper is rapidly improved as the amount of plasma energy reaches a lower value (such as approximately 0.2 J/cm$^2$ or lower), and is hardly improved by increasing the energy beyond that value. The pH value of the surface of the coated paper is reduced to a certain extent by increasing the amount of plasma energy. The pH value levels off when the amount of plasma energy exceeds a certain value (such as approximately 4 J/cm$^2$). The permeability (liquid-absorbing property) is rapidly improved beyond a point near the value (such as approximately 4 J/cm$^2$) where the decrease of pH value saturates. This phenomenon, however, varies depending on the polymer component contained in the ink.

As a result, the value of the beading (granularity) becomes at a very good level after the permeability (liquid-absorbing property) starts improving (for example, the pH value reaches approximately 4 J/cm$^2$). The beading (granularity) is a value numerically representing the roughness of an image, and represents a variation in the density represented by a standard deviation of mean densities. In FIG. 12, a plurality of densities of a solid image consisting of dots of two or more colors are sampled, and the standard deviation of the densities is represented as the beading (granularity). As described above, the ink ejected on the coated paper subjected to the plasma treatment according to the present embodiment permeates the coated paper while spreading in a perfect circular shape and being aggregated, so that the beading (granularity) in the image is improved.

As described above, in the relations between the surface properties of the treatment object 1020 and the image quality, the circularity of the dot improves as the wettability of the surface improves. This is considered to be because an increase in surface roughness and the generation of the hydrophilic polar functional groups by the plasma treatment improve and uniformize the wettability of the surface of the treatment object 1020. Another conceivable cause is that the plasma treatment removes water-repellent factors, such as contaminants, oil, and calcium carbonate, from the surface of the treatment object 1020. In other words, the droplets are considered to evenly spread in the circumferential direction so as to improve the circularity of the dots as a result of the improvement in the wettability of the surface of the treatment object 1020 and the removal of the destabilizing factors from the surface of the treatment object 1020.

Acidifying (by reducing the pH) the surface of the treatment object 1020 causes the ink pigments to be aggregated, improves the permeability, and lets the vehicles permeate into the coating layer. These increase the density of the pigments on the surface of the treatment object 1020, so that the movements of the pigments can be inhibited even when the dots have coalesced. As a result, the pigments can be prevented from mixing, and can be evenly deposited and aggregated on the surface of the treatment object 1020. The effect of preventing the pigment mixture varies depending on the components of the ink and the size of the ink droplet. For example, if the size of the ink droplet is small, the pigments are less likely to be mixed by the coalescence of the dots than in the case of a large droplet. This is because the vehicle having a smaller size is dried and permeates more quickly, and can aggregate the pigments with less pH reaction. The effect of the plasma treatment varies depending on the type of the treatment object 1020 and the environment (such as humidity). Hence, the amount of plasma energy in the plasma treatment may be controlled to an optimal value according to the droplet amount, the type of the treatment object 1020, and the environment. As a result, there are cases in which the surface modification efficiency of the treatment object 1020 can be improved, and a further energy saving can be achieved.

Figure 13:
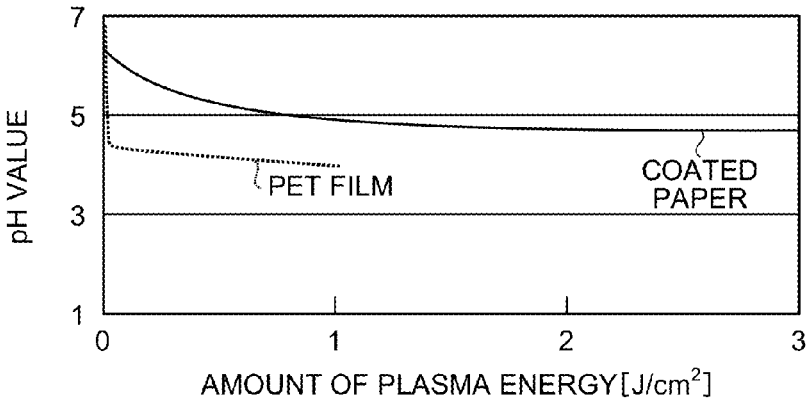
FIG. 13 is a diagram illustrating, for each medium, an example of a relation between the amount of plasma energy and the pH value of the surface of the treatment object.

FIG. 13 is a graph illustrating relations of the amount of plasma energy to pH values according to the second embodiment. While pH is normally measured in a solution, pH of a solid surface can be measured in these years. A pH meter B-211 manufactured by Horiba, Ltd. can be used as a measuring instrument for that purpose.

In FIG. 13, the solid line represents plasma energy dependence of the pH value of the coated paper, and the dotted line represents the plasma energy dependence of the pH value of a polyethylene terephthalate (PET) film. As illustrated in FIG. 13, the PET film is acidified at a lower amount of plasma energy than that for the coated paper. The coated paper was, however, also acidified at an amount of plasma energy of 3 $J/cm^2$ or lower. When an image was recorded on the treatment object 1020 having a pH value of 5 or lower using an inkjet processing apparatus that ejects the alkaline aqueous pigment ink, a dot of the formed image had a nearly perfect circular shape. No mixture of pigments by coalescence of the dots occurred, and a good image without blur was obtained (refer to FIG. 10).

The plasma treatment described above can be applied to the plasma treatment performed as the pretreatment in the pretreatment apparatus 30 in the first embodiment described above.

An image forming system according to the second embodiment will be described in detail with reference to drawings.

In the second embodiment, a description will be given of an image forming apparatus that includes ejection heads (recording heads or ink heads) for four colors of black (K), cyan (C), magenta (M), and yellow (Y). The ejection heads are, however, not limited to these examples. Specifically, the image forming apparatus may further include ejection heads for green (G), red (R), and other colors, or may include only an ejection head for black (K). In the following description, K, C, M, and Y correspond to black, cyan, magenta, and yellow, respectively.

In the second embodiment, a continuous sheet wound in a roll shape (hereinafter, called a rolled sheet) is used as the treatment object. The treatment object is, however, not limited to this example, but only needs to be a recording medium, such as a cut sheet, on which an image can be formed. If the treatment object is paper, various types of paper can be used, such as plain paper, high-quality paper, recycled paper, thin paper, thick paper, and coated paper. The recording media usable as the treatment object also include a transparency sheet, a synthetic resin film, a metal thin film, and others on which surface an image can be formed with ink or the like. If the paper is non-permeable or low-permeable to ink, like the coated paper, the present invention provides greater effects. The rolled sheet may be a continuous sheet (continuous form paper or continuous forms) that is perforated at regular intervals so as to be separable. In that case, a page of the rolled sheet refers to an area between perforations provided at regular intervals.

Figure 14:
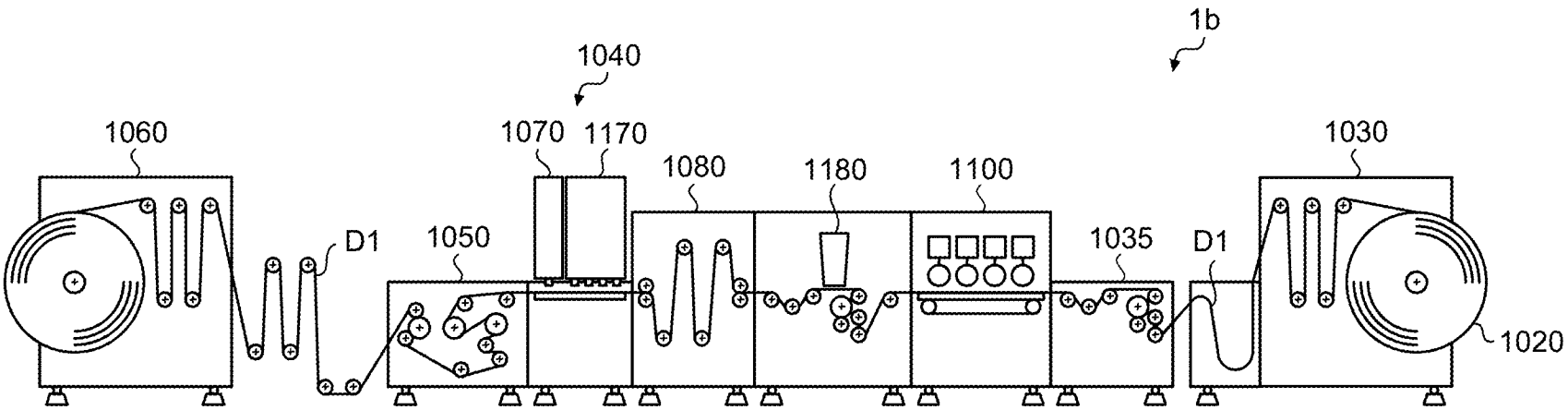
FIG. 14 is a schematic diagram illustrating the outline configuration of an image forming system according to the second embodiment.

FIG. 14 is a schematic diagram illustrating the outline configuration of a printer (image forming system) according to the second embodiment. As illustrated in FIG. 14, an image forming system 1*b* includes a feeding unit 1030 that feeds (conveys) the treatment object 1020 (rolled sheet) along a conveying path D1, a plasma treatment apparatus 1100 that performs the plasma treatment as the pretreatment on the fed treatment object 1020, and an image forming apparatus 1040 that forms an image on the plasma-treated surface of the treatment object 1020. These apparatuses may constitute a system as a whole while lying in separate housings, or may constitute a printer contained in one housing. When the apparatuses are configured as a printing system, a control unit that controls the whole or a part of the system may be included in any of the apparatuses, or may be provided in an independent housing.

When an image is formed in the image forming system 1*b*, the treatment object 1020 is conveyed as a whole in the direction from the right to the left in FIG. 14 that serves as the sheet feeding direction. The rotation direction of the rolled sheet (treatment object 1020) in this operation is defined as the normal rotation direction.

An adjustment unit 1035 is provided between the feeding unit 1030 and the plasma treatment apparatus 1100, and adjusts the tension of the treatment object 1020 fed to the plasma treatment apparatus 1100. A buffer unit 1080 is provided between the plasma treatment apparatus 1100 and an inkjet recording apparatus 1170, and is used for adjusting the amount of feed of the treatment object 1020 that has been subjected to the pretreatment, such as the plasma treatment, to the inkjet recording apparatus 1170. The image forming apparatus 1040 includes the inkjet recording apparatus 1170 that forms an image on the plasma-treated treatment object 1020 by performing inkjet processing. The image forming apparatus 1040 may further include a posttreatment unit 1070 that posttreats the treatment object 1020 on which the image has been formed.

The image forming system 1*b* may include a drying unit 1050 that dries the posttreated treatment object 1020, and a convey-out unit 1060 that conveys out the treatment object 1020 that has the image formed thereon (and has also been posttreated depending on the case). The image forming system 1*b* may also include, as a pretreatment unit pretreating the treatment object 1020, a precoating unit (not illustrated) that applies a treatment liquid called a precoating agent containing polymer material to the surface of the treatment object 1020, in addition to the plasma treatment apparatus 1100. The image forming system 1*b* may be provided, between the plasma treatment apparatus 1100 and the image forming apparatus 1040, with a pH detection unit 1180 for detecting the pH value of the surface of the treatment object 1020 that has been pretreated by the plasma treatment apparatus 1100.

The image forming system 1*b* further includes a control unit (not illustrated) that controls operations of the units. The control unit may be connected to a print control device that produces raster data from, for example, image data to be printed. The print control device may be provided in the image forming system 1*b*, or may be externally provided with a network, such as the Internet or a local area network (LAN), connecting the control unit to the print control device.

Of the units illustrated in FIG. 14, the feeding unit 1030 corresponds to the sheet feeding apparatus 40 in FIG. 1. The plasma treatment apparatus 1100 corresponds to the pretreatment apparatus 30 in FIG. 1. The buffer unit 1080 corresponds to the conveyance buffer apparatus 20 in FIG. 1, and includes either the sheet bending area 200 illustrated in FIG. 2 or the sheet bending area 200' illustrated in FIG. 6. The buffer unit 1080 is assumed here to include the sheet bending area 200 illustrated in FIG. 2. The image forming apparatus 1040 corresponds to the image forming apparatus 10 in FIG. 1.

In the second embodiment, the image forming system 1*b* illustrated in FIG. 14 performs the acidification treatment of acidifying the surface of the treatment object before the inkjet recording processing, as described above. The acidification treatment can employ, for example, atmospheric pressure nonequilibrium plasma treatment using dielectric barrier discharge. In the acidification treatment using the atmospheric pressure nonequilibrium plasma, the electron temperature is very high, and the gas temperature is close to the room temperature, so that the atmospheric pressure nonequilibrium plasma treatment is a preferable method for plasma treatment to the treatment object, such as a recording medium.

To stably produce the atmospheric pressure nonequilibrium plasma over a wide range, it is preferable to perform the atmospheric pressure nonequilibrium plasma treatment employing the dielectric barrier discharge based on streamer breakdown. The dielectric barrier discharge based on the streamer breakdown can be produced, for example, by applying an alternating high voltage between electrodes coated with a dielectric material.

Besides the above-described dielectric barrier discharge based on the streamer breakdown, various methods can be used as a method for producing the atmospheric pressure nonequilibrium plasma. For example, the method can employ dielectric barrier discharge produced by inserting an insulator, such as a dielectric material, between electrodes, corona discharge produced by generating a highly non-uniform electric field on a thin wire or the like, or pulsed discharge produced by applying a short pulse voltage. Two or more of these methods may also be combined.

Figure 15:
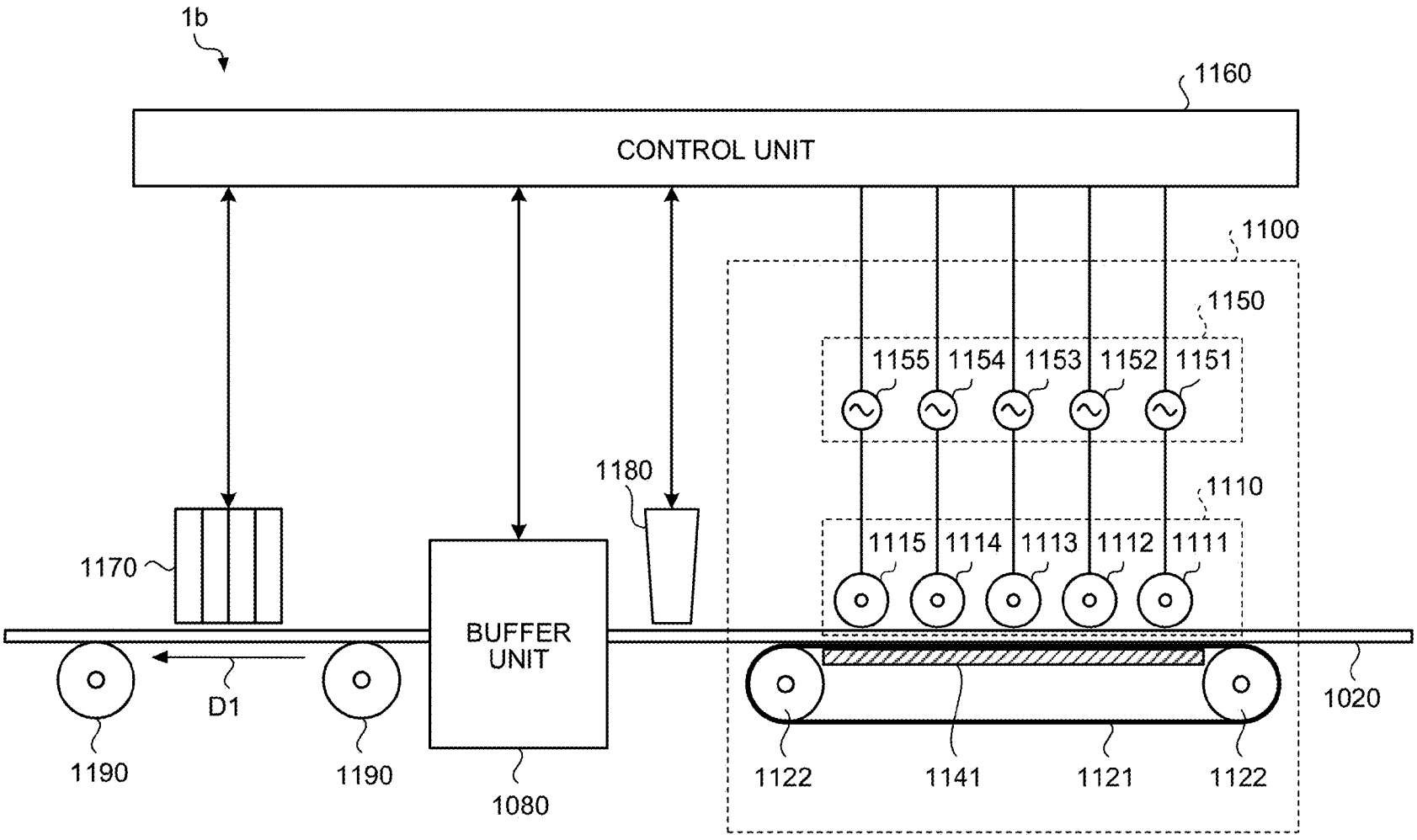
FIG. 15 is a schematic diagram illustrating the configuration of a portion ranging from the plasma treatment apparatus to an inkjet recording apparatus extracted from the image forming system according to the second embodiment.

FIG. 15 illustrates the configuration of a portion ranging from the plasma treatment apparatus 1100 to the inkjet recording apparatus 1170 extracted from the image forming system 1*b* illustrated in FIG. 14. As illustrated in FIG. 15, the image forming system 1*b* includes the plasma treatment apparatus 1100 that plasma-treats the surface of the treatment object 1020, the pH detection unit 1180 that measures the pH value of the surface of the treatment object 1020, the buffer unit 1080 that adjusts the amount of feed of the treatment object 1020 conveyed out of the plasma treatment apparatus 1100, the inkjet recording apparatus 1170 that forms an image on the treatment object 1020 using the inkjet recording, and a control unit 1160 that controls the entire image forming system 1*b*. The control unit 1160 corresponds to the overall control unit 100 illustrated in FIG. 3 explained above. The image forming system 1*b* also includes conveying rollers 1190 for conveying the treatment object 1020 along the conveying path D1. The conveying rollers 1190 conveys the treatment object 1020 along the conveying path D1 by rotational drive according to the control by the control unit 1160.

In a manner similar to the plasma treatment apparatus 1010 illustrated in FIG. 7, the plasma treatment apparatus 1100 includes a discharge electrode 1110, a counter electrode 1141, a high-frequency high-voltage power supply 1150, and a dielectric belt 1121 interposed between the electrodes. In FIG. 15, the discharge electrode 1110 is composed of five discharge electrodes 1111 to 1115, and the counter electrode 1141 is provided over the entire area facing the discharge electrodes 1111 to 1115 with the dielectric belt 1121 interposed between the counter electrode 1141 and the discharge electrodes 1111 to 1115. The high-frequency high-voltage power supply 1150 is composed of five high-frequency high-voltage power supplies 1151 to 1155, the number thereof corresponding to the number of the discharge electrodes 1111 to 1115.

To use the dielectric belt 1121 also for conveying the treatment object 1020, it is preferable to use an endless belt as the dielectric belt 1121. Hence, the plasma treatment apparatus 1100 further includes rotating rollers 1122 for conveying the treatment object 1020 by circulating the dielectric belt 1121. The rotating rollers 1122 circulates the dielectric belt 1121 by rotationally driving it based on a command from the control unit 1160. Thereby, the treatment object 20 is conveyed along the conveying path D1.

The control unit 1160 can individually turn on and off each of the high-frequency high-voltage power supplies 1151 to 1155. The control unit 1160 can also adjust the pulse intensities of high-frequency high-voltage pulses supplied by the high-frequency high-voltage power supplies 1151 to 1155 to the discharge electrodes 1111 to 1115, respectively.

The pH detection unit 1180 is arranged downstream of the plasma treatment apparatus 1100 and the precoating apparatus (not illustrated). The pH detection unit 1180 may detect the pH value of the surface of the treatment object 1020 pretreated (acidified) by the plasma treatment apparatus 1100 and/or the precoating apparatus, and enter the detected pH value into the control unit 1160. In response, the control unit 1160 may perform feedback control of the plasma treatment apparatus 1100 and/or the precoating apparatus (not illustrated) based on the pH value received from the pH detection unit 1180 so as to adjust the pH value of the pretreated surface of the treatment object 1020.

The amount of plasma energy required for the plasma treatment can be obtained, for example, from the voltage value and the application time of the high-frequency high-voltage pulses supplied from the high-frequency high-voltage power supplies 1151 to 1155 to the discharge electrodes 1111 to 1115, respectively, and the current that has flowed into the treatment object 1020 during the application time. The amount of plasma energy required for the plasma treatment may be controlled as an amount of energy of the discharge electrode 1110 as a whole, instead of being controlled for each of the discharge electrodes 1111 to 1115.

The treatment object 1020 is plasma-treated by passing between the discharge electrode 1110 and the dielectric belt 1121 while the plasma treatment apparatus 1100 is generating the plasma. This process breaks chains of a binder resin on the surface of the treatment object 1020, and further recombines the oxygen radical and the ozone in the gaseous phase with the polymers so as to generate the polar functional groups on the surface of the treatment object 1020. As a result, the hydrophilicity and the acidity are given to the surface of the treatment object 1020. While the plasma treatment is performed in the air atmosphere in the present example, the plasma treatment may be performed in a gas atmosphere, such as a nitrogen or noble gas atmosphere.

Providing a plurality of discharge electrodes (that is, the discharge electrodes 1111 to 1115) is also effective for uniformly acidifying the surface of the treatment object 1020. Specifically, for example, assuming the same conveying speed (or printing speed), the acidification treatment with a plurality of discharge electrodes can ensure longer time for the treatment object 1020 to pass through the space of the plasma than time ensured by the acidification treatment with one discharge electrode. As a result, the acidification treatment can be more uniformly performed on the surface of the treatment object 1020.

The treatment object 1020 plasma-treated in the plasma treatment apparatus 1100 is conveyed into the inkjet recording apparatus 1170 via the buffer unit 1080. The inkjet recording apparatus 1170 includes an inkjet head. The inkjet head includes, for example, a plurality of heads for the same color (such as 4 colors×4 heads) for obtaining a high printing speed. To perform high-speed image formation at a high resolution (such as 1200 dpi), the ink ejection nozzles of the heads for each of the colors are fixed in positions shifted from one another so as to provide correct gaps therebetween. In addition, the inkjet head can be driven at any of a plurality of frequencies so that dots (droplets) ejected from each of the nozzles can have the three volume types called the large, medium, and small droplets.

An inkjet head 1171 is arranged downstream of the plasma treatment apparatus 1100 in the conveying path of the treatment object 1020. Under control of the control unit 1160, the inkjet recording apparatus 1170 performs the image formation by ejecting ink onto the treatment object 1020 pretreated (acidified) by the plasma treatment apparatus 1100.

The inkjet head of the inkjet recording apparatus 1170 may include the heads for the same color (4 colors×4 heads) as illustrated in FIG. 15. This configuration enables high-speed inkjet recording processing. In this case, for example, to obtain the resolution of 1200 dpi at a high speed, the heads of each of the colors in the inkjet head are fixed in positions shifted from one another so as to provide correct gaps between nozzles for ejecting ink. In addition, drive pulses having various drive frequencies are fed to the heads of each of the colors so that the dots ejected from each of the nozzles of the heads can have the three volume types called the large, medium, and small droplets.

Providing a plurality of discharge electrodes (that is, the discharge electrodes 1111 to 1115) is also effective for uniformly plasma-treating the surface of the treatment object 1020. Specifically, for example, assuming the same conveying speed (or printing speed), the plasma treatment with a plurality of discharge electrodes can ensure longer time for the treatment object 1020 to pass through the space of the plasma than time ensured by the plasma treatment with one discharge electrode. As a result, the plasma treatment can be more uniformly performed on the surface of the treatment object 1020.

In the configuration described above, if an image is not formed in a plasma-treated region of the treatment object 1020 within a predetermined time after the treatment object 1020 is plasma-treated in the plasma treatment apparatus 1100, the image forming system 1*b* returns the treatment object 1020 so that the surface-treated region reaches a position at least before the plasma treatment apparatus 1100 (such as the position of the adjustment unit 1035). The image forming system 1*b* then conveys the treatment object 1020 along the conveying path D1, then performs the plasma treatment again in the plasma treatment apparatus 1100, and then forms the image in the image forming apparatus 1040.

With reference to the flowchart in FIG. 5 and the explanation thereof, a more specific description will be given of a method for controlling the print processing by the image forming system 1*b* according to the second embodiment. If a print job start command is received, for example, from the external computer device (refer to Step S100 in FIG. 5), the image forming system 1*b* starts conveying the treatment object 1020 in the sheet feeding direction according to the received print job start command (refer to Step S101 in FIG. 5). The treatment object 1020 is conveyed out of the feeding unit 1030, and fed to the plasma treatment apparatus 1100 via the adjustment unit 1035. The plasma treatment apparatus 1100 follows a command from the control unit 1160 to perform the plasma treatment on the treatment object 1020 passing through the plasma treatment apparatus 1100, and to feed the treatment object 1020 in the sheet feeding direction (refer to Step S102 in FIG. 5).

Then, the control unit 1160 commands the image forming apparatus 1040 to start forming an image according to print job data on the treatment object 1020.

The treatment object 1020 fed from the plasma treatment apparatus 1100 is fed to the buffer unit 1080. In the sheet bending area 200 in the buffer unit 1080, the tension of the treatment object 1020 is adjusted to the predetermined level as described in the first embodiment, and the treatment object 1020 is fed from the buffer unit 1080. The treatment object 1020 fed from the buffer unit 1080 is fed to the image forming apparatus 1040. The image forming apparatus 1040 uses the inkjet recording apparatus 1170 to form an image according to the print job data on the treatment object 1020 that is fed at a predetermined conveying speed (refer to Step S103 in FIG. 5).

Suppose that a command to stop the print job for which the image is being formed is issued before the print job is completed, that is, in the middle of the print job (refer to Step S104 in FIG. 5). The control unit 1160 follows this print job stop command to stop the print job, for example, by stopping the operation of the image forming system 1*b*. For example, the control unit 1160 commands the feeding unit 1030 to stop conveying the treatment object 1020, and commands the plasma treatment apparatus 1100 to stop performing the plasma treatment. The control unit 1160 also commands the image forming apparatus 1040 to stop conveying the treatment object 1020, and to stop the inkjet recording apparatus 1170 from forming the image.

When the print job has stopped, the control unit 1160 starts the measurement of time, for example, based on a timer count (refer to Step S105 in FIG. 5). The control unit 1160 waits for a print job start command (refer to Step S106 in FIG. 5), and if the print job start command is received, determines whether the time (timer count) measured since the stop of the print job has exceeded a predetermined value (refer to Step S107 in FIG. 5).

If not, the control unit 1160 issues a command to the feeding unit 1030 to start conveying the treatment object 1020, thereby causing the feeding unit 1030 to start conveying the treatment object 1020 (refer to Step S108 in FIG. 5). The control unit 1160 also issues a command to the image forming apparatus 1040 to start forming the image according to the print job data on the treatment object 1020, thereby causing the start of the image formation on the treatment object 1020 (refer to Step S109 in FIG. 5).

If the time measured since the stop of the print job has exceeded the predetermined value, the control unit 1160 commands the feeding unit 1030 to rotate the rolled sheet (treatment object 1020) in the reverse rotation direction opposite to the normal rotation direction. The feeding unit 1030 follows this command to rotate the rolled sheet (treatment object 1020) in the reverse rotation direction, and thus rewinds the rolled sheet. This starts a conveyance of the treatment object 1020 from the left to the right in FIG. 14 (Step S120 in FIG. 5).

If the amount of the rewound treatment object 1020 has reached a predetermine amount, the control unit 1160 commands the feeding unit 1030 to convey again the treatment object 1020 in the sheet feeding direction, that is, toward the plasma treatment apparatus 1100. The feeding unit 1030 follows this command to rotate the rolled sheet in the normal rotation direction, and thus resumes the conveyance of the treatment object 1020 toward the sheet feeding direction (Step S121 in FIG. 5).

The control unit 1160 can determine whether the amount of the treatment object 1020 rewound into the feeding unit 1030 has reached the predetermined amount, for example, according to the determination result on the amount of bending based on the outputs of the sensors $\mathbf{120}_1$ and $\mathbf{120}_2$, as described in the first embodiment. The determination criterion is not limited to this example, but the control unit 1160 may start the conveyance in the normal rotation direction if a certain time has elapsed after the feeding unit 1030 has started conveying the treatment object 1020 in the reverse rotation direction.

When the treatment object 1020 has started to be conveyed in the sheet feeding direction, the control unit 1160 commands the plasma treatment apparatus 1100 to start performing the plasma treatment on the treatment object 1020. The plasma treatment apparatus 1100 follows this command to start performing the plasma treatment (refer to Step S122 in FIG. 5). The plasma treatment apparatus 1100 feeds the plasma-treated treatment object 1020 in the sheet feeding direction. The treatment object 1020 fed from the plasma treatment apparatus 1100 is fed to the buffer unit 1080 via the pH detection unit 1180, and, after the amount of feed is adjusted in the buffer unit 1080, is fed from the image forming apparatus 1040.

Further, the control unit 1160 commands the image forming apparatus 1040 to start forming the image according to the print job data on the treatment object 1020. The image forming apparatus 1040 follows this command to perform printing by forming the image according to the print job data on the treatment object 1020 fed from the buffer unit 1080.

In this manner, also in the second embodiment, after the print operation according to the print job is stopped halfway and the plasma-treated treatment object 1020 is retained in the buffer unit 1080, the print operation according to the next print job is started by once rewinding the retained treatment object 1020 into the feeding unit 1030, feeding the rewound treatment object 1020 out of the feeding unit 1030 and plasma-treating it again, and feeding the plasma-treated treatment object 1020 to the image forming apparatus 1040 via the buffer unit 1080. As a result, in the same manner as in the case of the first embodiment, the plasma treatment is appropriately performed as the pretreatment, so that a high-quality printed image can be obtained.

An aspect of the present invention provides the effect of obtaining an appropriate effect of surface treatment in the configuration including a sheet buffer after the surface treatment and before the image formation onto the sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a driving unit that feeds a treatment object;

a pretreatment unit that performs pretreatment on a surface of the treatment object fed by the driving unit;

a retaining unit that retains the treatment object on which the pretreatment has been performed in the pretreatment unit;

an image forming unit that performs image formation on the treatment object after being retained in the retaining unit; and a drive control unit that controls the driving unit so as to return the treatment object from the retaining unit at least to the pretreatment unit if the treatment object has been retained in the retaining unit for a time longer than a predetermined time after being subjected to the pretreatment in the pretreatment unit, and to feed the treatment object on which the pretreatment has been performed again in the pretreatment unit to the retaining unit;

wherein the predetermined time is a time elapsed after the pretreatment ends until the image formation starts in a case in which a region of the treatment object is subjected to the pretreatment in the pretreatment unit and the image formation by the image forming unit.

2. The image forming apparatus according to claim 1, wherein the predetermined time is changed depending on a type of the treatment object.

3. The image forming apparatus according to claim 1, wherein the predetermined time is changed depending on ambient humidity of an area including at least the retaining unit.

4. The image forming apparatus according to claim 1, wherein the pretreatment unit performs the pretreatment by plasma treatment to the treatment object.

5. An image forming system comprising:

a sheet feeding apparatus that feeds a treatment object;

a pretreatment apparatus that performs pretreatment on a surface of the treatment object fed by the sheet feeding apparatus;

a buffer apparatus that retains the treatment object on which the pretreatment has been performed in the pretreatment apparatus;

an image forming apparatus that performs image formation on the treatment object after being retained in the buffer apparatus; and a drive control unit that controls the sheet feeding apparatus so as to return the treatment object from the buffer apparatus at least to the pretreatment apparatus if the treatment object has been retained in the buffer apparatus for a time longer than a predetermined time after being subjected to the pretreatment in the pretreatment apparatus, and to feed the treatment object on which the pretreatment has been performed again in the pretreatment apparatus to the buffer apparatus;

wherein the predetermined time is a time elapsed after the pretreatment ends until the image formation starts in a case in which a region of the treatment object is subjected to the pretreatment in the pretreatment apparatus and the image formation by the image forming apparatus.

6. A method of producing a printed product, the method comprising:

driving to feed a treatment object;

performing pretreatment on a surface of the treatment object fed at the driving in a pretreatment unit;

retaining the treatment object on which the pretreatment has been performed at the performing pretreatment in a retaining unit;

performing image formation on the treatment object after being retained at the retaining in an image forming unit; and controlling the driving so as to return the treatment object from the retaining unit at least to the pretreatment unit if the treatment object has been retained at the retaining for a time longer than a predetermined time after being subjected to the pretreatment at the performing pretreatment, and to feed the treatment object on which the pretreatment has been performed again at the performing pretreatment to the retaining unit;

wherein the predetermined time is a time elapsed after the pretreatment ends until the image formation starts in a case in which a region of the treatment object is subjected to the pretreatment in the pretreatment unit and the image formation by the image forming unit.

* * * * *